US010128565B2

(12) United States Patent
Aizawa

(10) Patent No.: US 10,128,565 B2
(45) Date of Patent: Nov. 13, 2018

(54) ANTENNA AND ELECTRONIC APPARATUS

(71) Applicant: Seiko Epson Corporation, Tokyo (JP)

(72) Inventor: Tadashi Aizawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/073,917

(22) Filed: Mar. 18, 2016

(65) Prior Publication Data

US 2016/0285157 A1 Sep. 29, 2016

(30) Foreign Application Priority Data

Mar. 24, 2015 (JP) ..... 2015-061212

(51) Int. Cl.

| | |
|---|---|
| ***H01Q 1/24*** | (2006.01) |
| ***H01Q 1/27*** | (2006.01) |
| ***H01Q 1/48*** | (2006.01) |
| ***G04R 60/12*** | (2013.01) |
| ***G04R 20/04*** | (2013.01) |
| ***G04R 60/10*** | (2013.01) |
| ***H01Q 9/42*** | (2006.01) |

(52) U.S. Cl.
CPC ..... *H01Q 1/273* (2013.01); *G04R 20/04* (2013.01); *G04R 60/10* (2013.01); *G04R 60/12* (2013.01); *H01Q 1/48* (2013.01); *H01Q 9/42* (2013.01)

(58) Field of Classification Search
CPC ..... H01Q 1/48; H01Q 1/24; H01Q 1/273
USPC ..... 343/702
See application file for complete search history.

(56) References Cited

U.S. PATENT DOCUMENTS

| | | | | |
|---|---|---|---|---|
| 5,699,319 | A * | 12/1997 | Skrivervik | G04G 21/04 343/718 |
| 6,904,296 | B2 * | 6/2005 | Geeraert | H01Q 1/243 343/700 MS |
| 7,828,697 | B1 * | 11/2010 | Oberrieder | A63B 24/0062 482/1 |
| 8,562,489 | B2 * | 10/2013 | Burton | G04F 10/00 482/1 |
| 8,698,680 | B2 | 4/2014 | Gutschenritter et al. | |
| 9,172,148 | B2 * | 10/2015 | Lyons | H01Q 1/273 |
| 2006/0114162 | A1 * | 6/2006 | Minami | G04G 21/04 343/718 |
| 2006/0227058 | A1 * | 10/2006 | Zellweger | H01Q 1/273 343/718 |
| 2008/0316115 | A1 * | 12/2008 | Hill | H01Q 1/243 343/702 |
| 2013/0181873 | A1 | 7/2013 | Gutschenritter et al. | |
| 2015/0099474 | A1 * | 4/2015 | Yarga | H04B 1/0064 455/77 |
| 2016/0218419 | A1 * | 7/2016 | Vance | H01Q 1/241 |

(Continued)

FOREIGN PATENT DOCUMENTS

JP 2011-171856 A 9/2011

*Primary Examiner* — Huedung Mancuso
(74) *Attorney, Agent, or Firm* — Kilpatrick Townsend & Stockton LLP

(57) ABSTRACT

An antenna includes a first radiation element, a ground plate having a grounding point to which the first radiation element is grounded, and a second radiation element grounded to the ground plate and in a position where the grounding point is electrically shared with the first radiation element, and the second radiation element is disposed along the direction of current produced by the first radiation element and flowing in the ground plate.

9 Claims, 16 Drawing Sheets

(56) References Cited

U.S. PATENT DOCUMENTS

2017/0092090 A1* 3/2017 Lerner ..... G06K 7/10366
2017/0093019 A1* 3/2017 Toh ..... H01Q 1/2291

* cited by examiner

ANTENNA AND ELECTRONIC APPARATUS

CROSS-REFERENCE TO RELATED APPLICATIONS

This application claims priority to Japanese Patent Application No. 2015-061212, filed Mar. 24, 2015, the entirety of which is hereby incorporated by reference.

BACKGROUND

1. Technical Field

The present disclosure relates to an antenna and an electronic apparatus including the antenna.

2. Related Art

To incorporate a GPS (global positioning system) receiver in a compact enclosure, such as a wristwatch, an antenna used in the receiver is also required to be minimized in terms of volume. Products from manufacturers therefore each employ a ground plane antenna, which uses a circuit substrate as ground (GND). In a case where a ground plane antenna is employed, however, when a wristwatch is worn around an arm, for example, the arm absorbs electric waves so that the sensitivity of the antenna tends to lower as compared with a state in which the wristwatch is not worn around an arm. To avoid the situation described above, an approach for substantially enlarging GND is employed as follows: An electrically conductive member having a flat surface section and a holding section holds the circuit substrate is used to hold the circuit substrate (United States Patent Application Publication No. 2013/0181873).

The holding member in the United States Patent Application Publication No. 2013/0181873 is, however, so attached as to surround not only the circuit substrate but also members around the circuit substrate. The holding member cannot therefore be structurally employed in some cases.

SUMMARY OF INVENTION

At least one application example of the present disclosure provides an antenna the sensitivity of which does not greatly lower even when used at a location close to an arm or any other body part and further provides an electronic apparatus including the antenna.

The present disclosure can be implemented in the following aspects or application examples:

Application Example 1

An antenna according to this application example includes a first radiation element, a ground plate having a ground point to which the first radiation element is grounded, and a second radiation element grounded to the ground plate and in a position where the ground point is electrically shared, and the second radiation element is disposed along a direction of current produced by the first radiation element and flowing in the ground plate.

According to this application example, the antenna includes the first radiation element and the second radiation element, which electrically share a ground point on the ground plate, and the second radiation element is disposed along the direction of current produced by the first radiation element and flowing in the ground plate. Therefore, even when the ground plate cannot be sufficiently enlarged, the distribution of the current produced by the first radiation element and flowing in a ground plate that is larger than the actual ground plate is reproduced by the second radiation element. Therefore, since the directivity of the antenna approaches the directivity of a ground plane antenna, that is, the directivity in the direction parallel to the ground plate, electric power absorbed by an arm or any other body part can be reduced even when the antenna is located in a position close to the arm or any other body part, whereby a decrease in sensitivity of the antenna can be avoided.

Application Example 2

In the antenna according to the application example described above, the second radiation element may be present in a position where the first radiation element and the second radiation element are symmetric with respect to the ground plate.

According to the application example described above, even when the ground plate cannot be sufficiently enlarged, an image formed in a position where the first radiation element and the image are symmetric with respect to a sufficiently large ground plate is actually present as the second radiation element. The distribution of the current produced by the first radiation element and flowing on the sufficiently large ground plate is therefore reproduced by the second radiation element. Therefore, since the directivity of the antenna approaches the directivity of a ground plane antenna, that is, the directivity in the direction parallel to the ground plate, electric power absorbed by an arm or any other body part can be reduced even when the antenna is located in a position close to the arm or any other body part, whereby a decrease in sensitivity of the antenna is avoided.

Application Example 3

In the antenna according to the application example described above, the second radiation element and the first radiation element may be positioned on the same side of the ground plate.

According to the application example described above, even when the ground plate cannot be sufficiently enlarged, the distribution of the current produced by the first radiation element and flowing on a sufficiently large ground plate is reproduced by the second radiation element. Therefore, the directivity of the antenna approaches the directivity of a ground plane antenna, and electric power absorbed by an arm or any other body part can be reduced even when the antenna is located in a position close to the arm or any other body part, whereby a decrease in sensitivity of the antenna is avoided.

Application Example 4

In the antenna according to the application example described above, each of the first radiation element and the second radiation element may have an arcuate shape in a plan view of the ground plate (in a state in which a flat surface of the ground plate is viewed in the direction perpendicular thereto).

According to the application example described above, in which each of the radiation elements has an arcuate shape, when the antenna is accommodated in a cylindrical enclosure, for example, the antenna can be readily disposed in accordance with the shape of the enclosure, whereby the second radiation element can prevent a decrease in sensitivity of the antenna.

Application Example 5

In the antenna according to the application example described above, the second radiation element may have a bent section.

According to the application example described above, even when the second radiation element has a bent section, the second radiation element as a whole reproduces the distribution of the current produced by the first radiation element and flowing on a sufficiently large ground plate as long as the position of one end of the second radiation element viewed from the other end thereof connected to the grounding point is present in the direction of the current produced by the first radiation element and flowing in the ground plate. A decrease in sensitivity of the antenna is avoided even when a shape restriction is imposed on the second radiation element at the location where the second radiation element is disposed.

Application Example 6

In the antenna according to the application example described above, each of the first radiation element and the second radiation element preferably has an equivalent electrical length of ¼ times a wavelength.

According to the application example described above, the sum of the equivalent electrical length of the first radiation element and the equivalent electrical length of the second radiation element is ½ times the wavelength, whereby the antenna according to the present disclosure can be operated under the condition that the operating wavelength is ½ times the wavelength.

Application Example 7

An electronic apparatus according to this application example includes a first radiation element, a ground plate having a grounding point to which the first radiation element is grounded, and a second radiation element grounded to the ground plate and in a position where the grounding point is electrically shared, and the second radiation element is disposed along a direction of current produced by the first radiation element and flowing in the ground plate.

According to the application example described above, even when the ground plate cannot be sufficiently enlarged, an image formed in a position where the first radiation element and the image are symmetric with respect to a sufficiently large ground plate is actually present as the second radiation element. The distribution of the current produced by the first radiation element and flowing on the sufficiently large ground plate is therefore reproduced by the second radiation element. Therefore, since the directivity of the antenna approaches the directivity of a ground plane antenna, that is, the directivity in the direction parallel to the ground plate, electric power absorbed by an arm or any other body part can be reduced even when the antenna is located in a position close to the arm or any other body part, whereby a decrease in sensitivity of the antenna is avoided and the antenna satisfactorily operates. The electronic apparatus is a concept including not only a wristwatch-type electronic timepiece, a running watch, and a wristwatch-type heart rate monitor and other wristwatch-type electronic apparatus but also an earphone-type GPS apparatus, a smartphone and other electronic terminals, a head mounted display, and a variety of other electronic apparatus.

Application Example 8

The electronic apparatus according to the application example may further include a display section, a case that accommodates the display section and the antenna and includes a case back, and a passive element containing a metal. The passive element may be positioned on an opposite side of the display section with respect to the case back, and the first radiation element may be positioned between the passive element and the case back.

According to the application example described above, the passive element electromagnetically coupled with the first radiation element allows an increase in the distance between the ground plate and a radiation reception surface, whereby the radiation efficiency of the antenna is improved. Further, since the passive element is used as part of the antenna, the volume of the first radiation element can be reduced as compared with a case where no passive element is present.

Application Example 9

In the electronic apparatus according to the application example, the ground plate may be a circuit substrate of the electronic apparatus.

According to the application example described above, since a circuit substrate used in the electronic apparatus is used as the ground plate, which is a component of the antenna, the number of constituent parts can be reduced as compared with a case where a ground plate is provided separately from the circuit substrate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
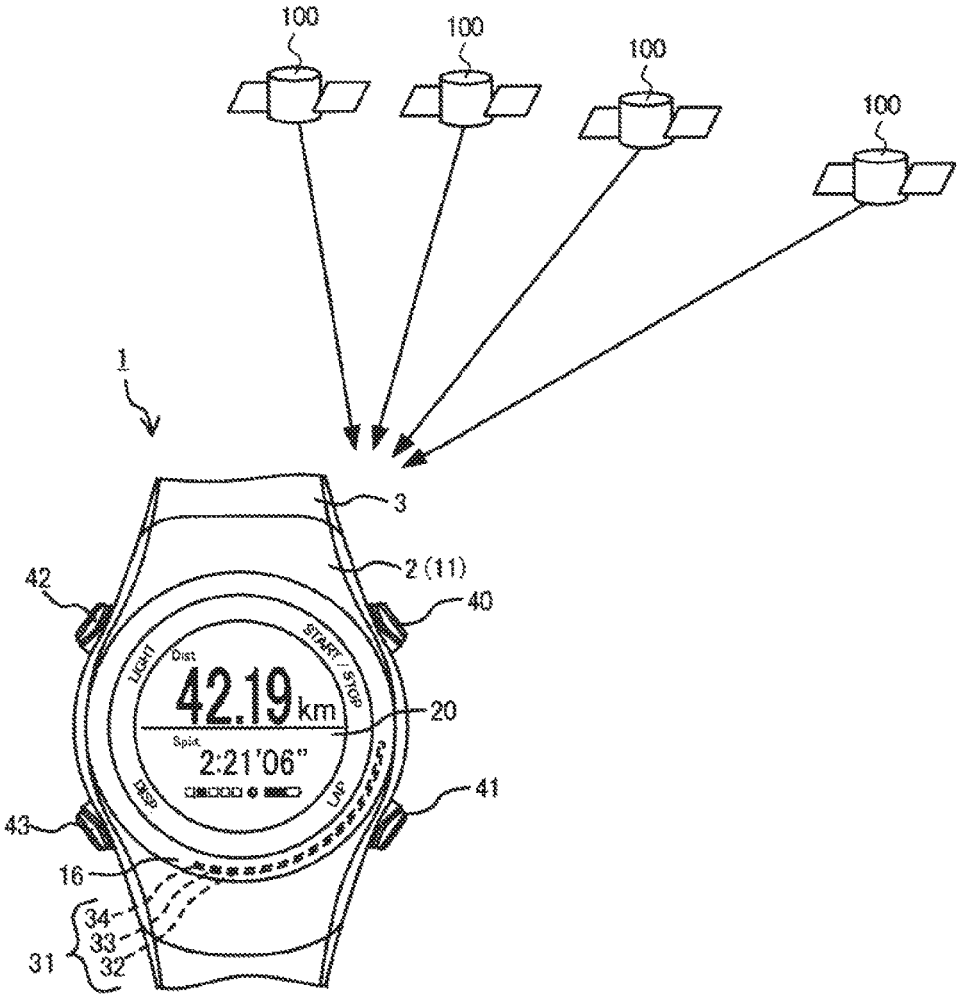
FIG. 1 is an overall view showing an example of a GPS system including a running watch having a built-in antenna according to a first embodiment.

Preferable embodiments according to the present disclosure will be described below with reference to the accompanying drawings. In the drawings, the dimension and scale of each portion differ as appropriate from actual values. Further, since the embodiments described below are preferable specific examples of the present disclosure, a variety of technically preferable restrictions are imposed on the embodiments, but the scope of the present disclosure is not limited to the restricted forms unless otherwise particularly stated in the following description that a restriction is imposed on the present disclosure.

First Embodiment

A: Mechanistic Configuration of Electronic Apparatus Having Built-In Antenna

An electronic apparatus 1 according to the present embodiment is a wristwatch-type running watch worn around a user's wrist and has a built-in GPS function that allows a GPS receiver to receive satellite signals (GPS signals) transmitted from several GPS satellites 100 present up in the sky and the watch to calculate the current position thereof, as shown in FIG. 1. The electronic apparatus 1 can measure, for example, the distance over which the user has run, the speed at which the user has run, and the path along which the user has run on the basis of position information and time information calculated by using the GPS signals and can therefore assist the user's exercise.

Figure 2:
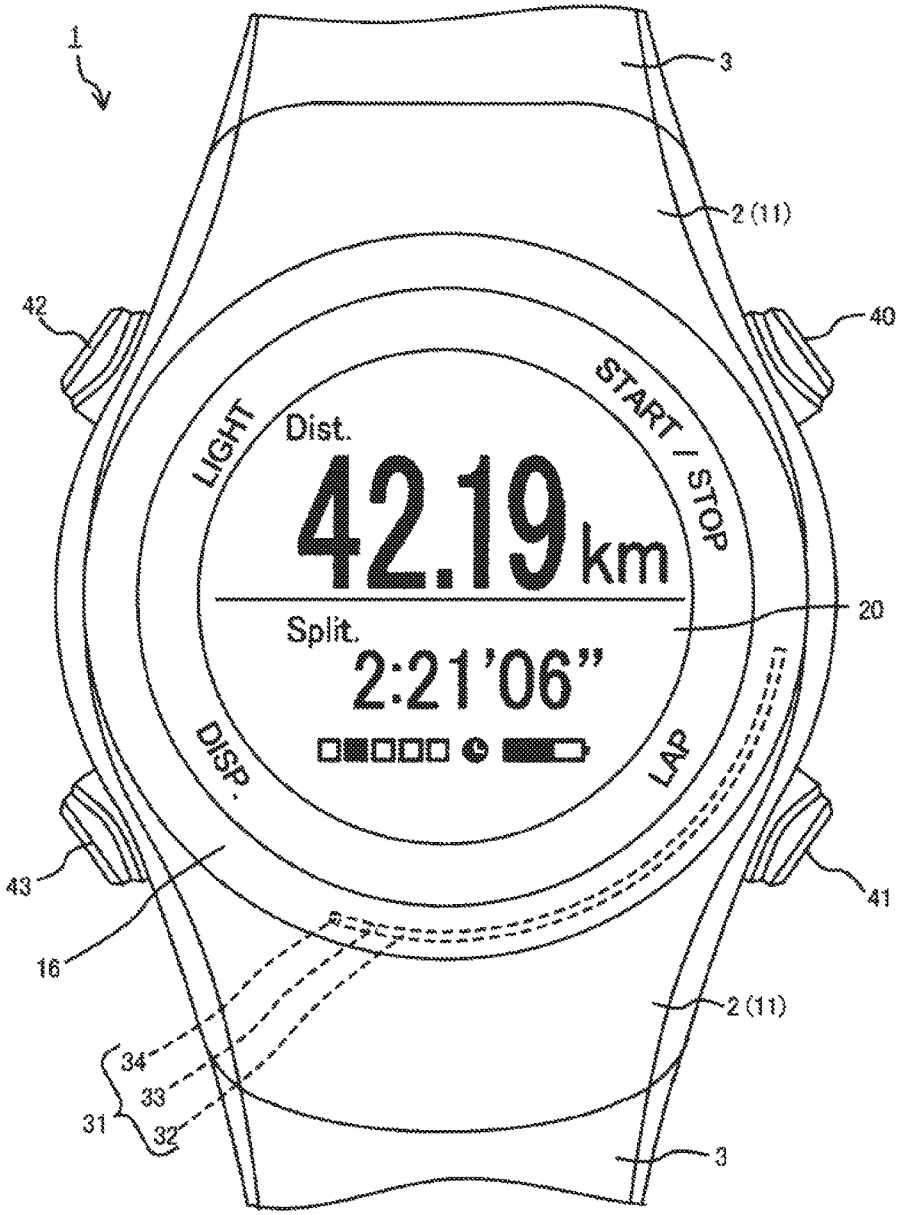
FIG. 2 is a plan view of an electronic apparatus.
Figure 3:
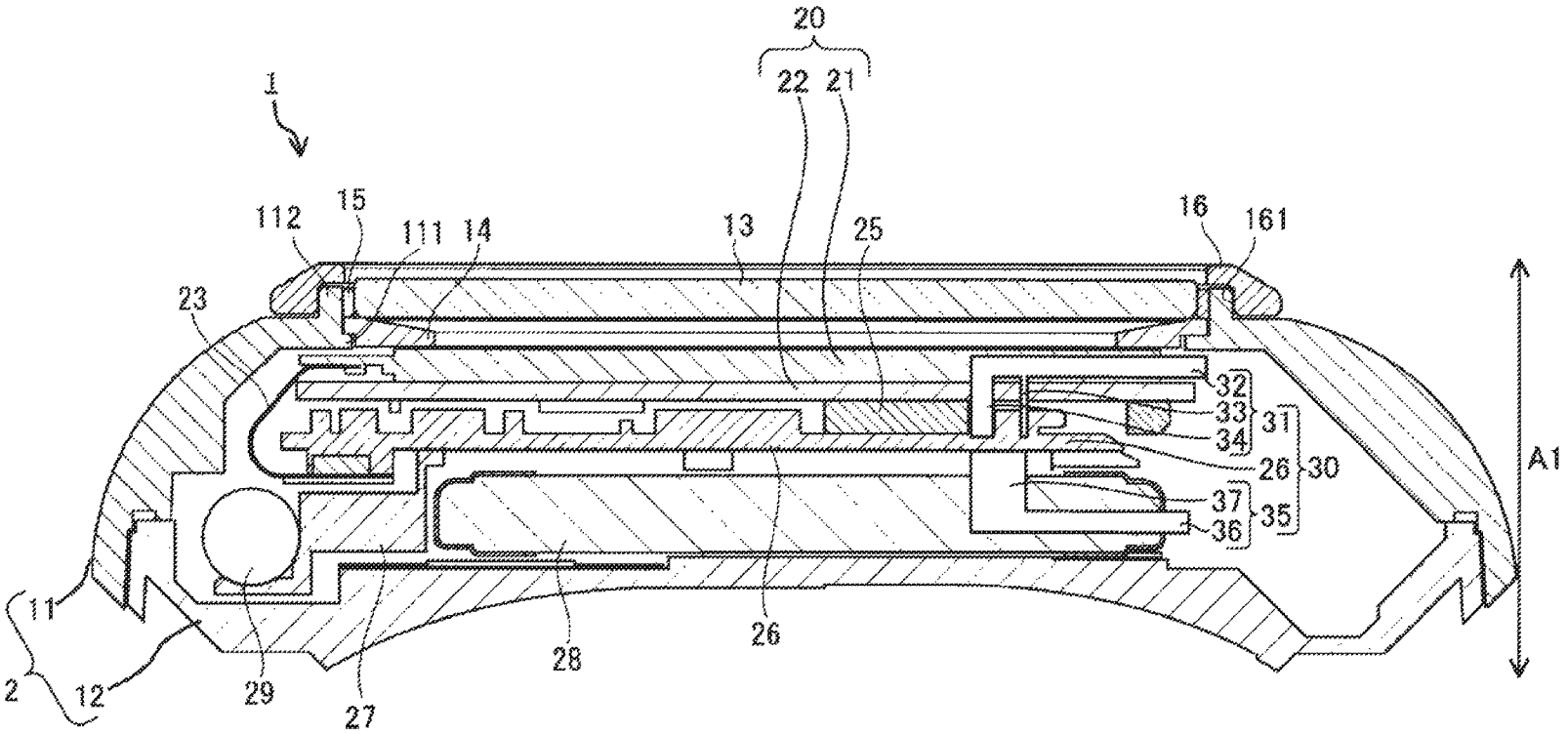
FIG. 3 is a partial cross-sectional view of the electronic apparatus.
Figure 4:
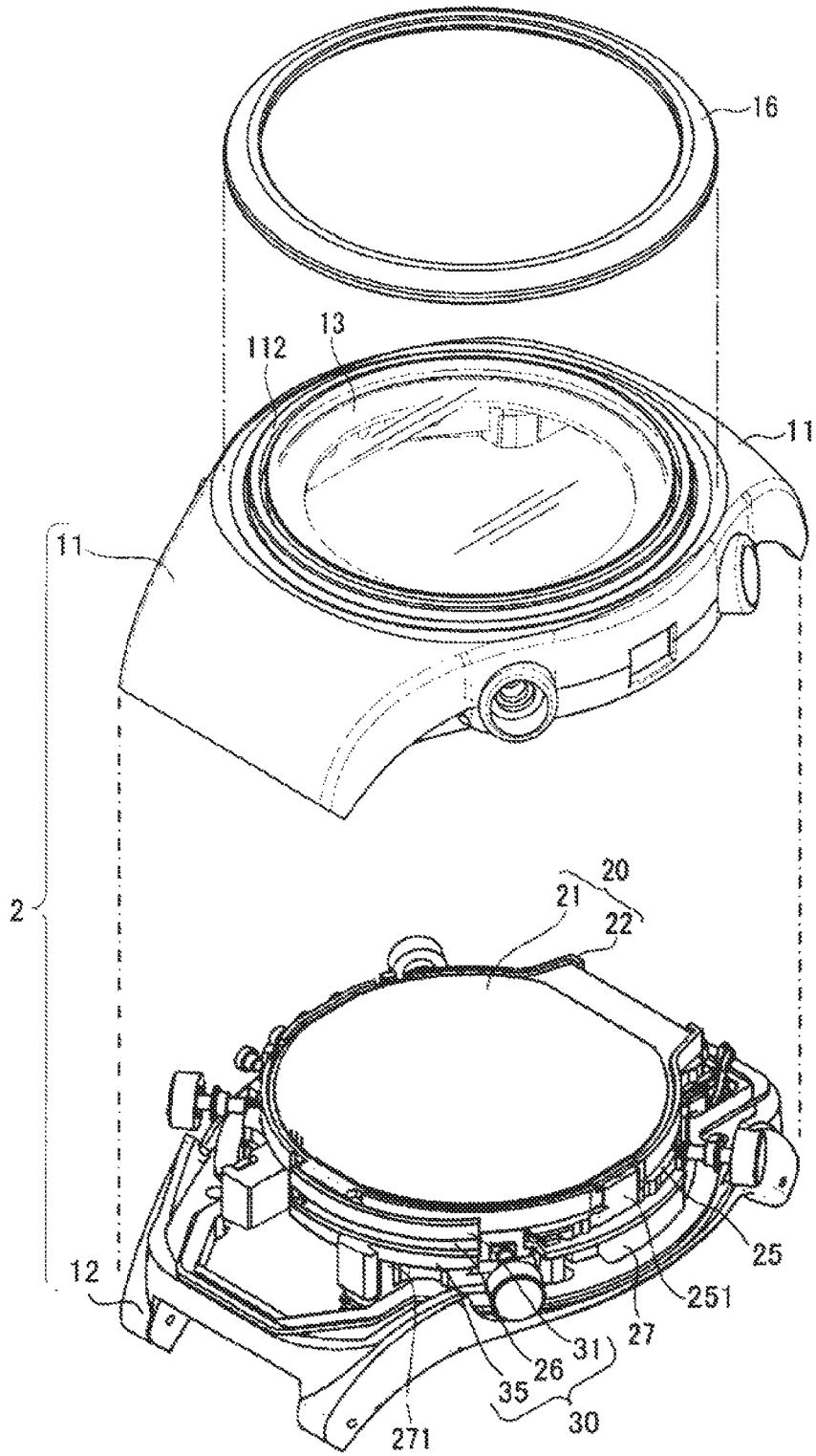
FIG. 4 is a partial exploded perspective view of the electronic apparatus.

The electronic apparatus 1 includes an exterior case 2 and bands 3, as also shown in FIGS. 2 to 4. In the electronic apparatus 1, the side where the user visually recognizes time and measured data is called a front surface side, and the side to be attached to an arm is called a rear surface side. Further, the upward-direction side of characters or numerals displayed in the electronic apparatus 1 is called a 12-o'clock side, and the downward-direction side of the displayed characters or numerals is called a 6-o'clock side. This time-associated representation is representation according to the time display in a typical analog wristwatch to which the wristwatch-type electronic apparatus 1 is likened. Further, the direction connecting the rear surface side and the front surface side of the electronic apparatus 1 to each other (direction labeled with arrow A1 in FIG. 3) is called a thickness direction A1 of the electronic apparatus 1.

The exterior case 2 includes a case body 11 and a case back 12. The case body 11 is made of a plastic material, such as a polycarbonate resin, or and formed in a roughly cylindrical shape. The case back 12 is attached to the rear surface side of the case body 11, which is the side facing the arm around which the electronic apparatus 1 is worn, and the case back 12 closes an opening of the case body 11 on the rear surface side. The case back 12 may be made of the same plastic material as that of the case body 11 or may be made of a metal, such as stainless steel.

The exterior case may instead be a one-piece case in which the case body 11 and the case back 12 are integrated with each other. Both in the form in which the case body 11 and the case back 12 are integrated with each other and the form in which they are separate from each other, a portion corresponding to the case body 11 is called a case body, and a portion corresponding to the case back 12 is called a case back.

A glass plate (protective plate) 13, which is a light transmissive member, is attached into an opening on the front surface side of the case body 11, that is, the exterior case 2. The glass plate 13 may instead be made of ITO (indium tin oxide), or ITO may be patterned on the glass plate 13. To support the glass plate 13, a protrusion 111, which protrudes inward in the front-surface-side opening of the case body 11, is formed along the inner circumferential surface of the opening, as shown in FIG. 3. Further, a circumferential protruding stripe 112, which has a continuous inner circumferential surface along the inner circumferential surface of the opening described above and protrudes toward the front surface side of the electronic apparatus 1, is formed on the front surface of the case body 11.

A support ring 14, which supports the glass plate 13, is locked onto the front surface side of the protrusion 111. The glass plate 13 is placed on the front surface side of the support ring 14. A ring-shaped gasket 15 is disposed between the glass plate 13 and the protruding stripe 112.

After the support ring 14 is disposed on the protrusion 111 of the case body 11, the glass plate 13 is placed inside the protruding stripe 112 via the gasket 15 and press-fit into the case body 11. The glass plate 13 is thus attached to the case body 11.

As the light transmissive member, the glass plate 13 is not necessarily made of glass and may be made of a plastic material, that is, only needs to be a plate-shaped member that allows the user to visually recognize the rear surface side (display section 20, which will be described later) of the light transmissive member through the front surface side thereof.

A bezel 16 is attached to the front surface side of the case body 11. The bezel 16 is made of a metal, such as stainless steel, titanium, aluminum, copper, and silver, and formed in a ring shape. The bezel 16 can instead be formed of a plated member. Further, the bezel 16 may contain ITO. A groove 161, into which the outer circumferential surface of the protruding stripe 112 described above is press-fit, is formed in the rear surface of the bezel 16.

The diameter of the inner circumferential surface of the groove 161 is so dimensioned as to be roughly equal to the diameter of the outer circumferential surface of the protruding stripe 112 described above. Even when the press-fit glass plate 13 forces the protruding stripe 112 to be deformed toward the outer circumferential side, the bezel 16, which is made of a metal and into which the protruding stripe 112 is press-fit, prevents deformation of the protruding stripe 112. That is, the bezel 16 also has a function of reinforcement the press-fitting and fixation of the glass plate 13 to the case body 11. Since the bezel 16 prevents the protruding stripe 112 from being deformed toward the outer circumferential side, the gasket 15 can be disposed between the glass plate 13 and the protruding stripe 112 with no gap and provide necessary waterproof capability.

A display section 20, a spacer 25, a circuit substrate 26, and a circuit case 27 are sequentially disposed in the direction from the side facing the glass plate 13 (front surface side) toward the side facing the case back 12 (rear surface side) in an internal space between the case body 11 and the case back 12 (internal space of exterior case 2), as shown in FIG. 4.

In the internal space of the exterior case 2, a first ribbon 31 is disposed on the side facing the side surface of the display section 20. The first ribbon 31 is disposed in a position shifted from the display section 20, which is located at the center of the front surface of the electronic apparatus 1, toward one of the bands 3 (6-o'clock-side of wristwatch), as shown in FIG. 4. The first ribbon 31 includes a ribbon section 32, a power feeder 33, and an antenna electrode 34. The power feeder 33 and the antenna electrode 34 are connected to the circuit substrate 26, as shown in FIG. 3. The power feeder 33 is connected to a signal pattern in the circuit substrate 26, and the antenna electrode 34 is connected to a GND pattern on the circuit substrate 26.

A second ribbon 35 is further disposed in a position where the first ribbon 31 and the second ribbon 35 are symmetric with respect to the circuit substrate 26, as shown in FIG. 3. The second ribbon 35 includes a ribbon section 36 and an antenna electrode 37. The antenna electrode 37 is connected to the GND pattern on the circuit substrate 26.

In the present embodiment, the first ribbon 31, the circuit substrate 26, and the second ribbon 35 form an antenna 30. The configuration of the antenna 30 will be described later in detail.

The display section 20 includes a liquid crystal panel 21 with a backlight and a panel frame 22, which holds the liquid crystal panel 21. The liquid crystal panel 21 is connected to the circuit substrate 26 via a flexible substrate 23. The panel frame 22 is formed of a non-electro-conductive member made, for example, of a plastic material.

The spacer 25 is formed of a non-electro-conductive member made, for example, of a plastic material and disposed between the panel frame 22 and the circuit substrate 26. A plurality of hooks 251 are so formed on the front surface of the spacer 25 (surface facing glass plate 13) as to protrude therefrom, and the hooks 251 hold the panel frame 22 of the display section 20 described above.

On the circuit substrate 26 are mounted a variety of ICs and other component that control display on the display section 20 and process satellite signals received with the antenna 30. In the present embodiment, the circuit substrate 26 also functions as a ground (GND) plate.

The circuit case 27 is formed of a non-electro-conductive member made, for example, of a plastic material and holds a secondary battery 28, a vibration motor 29, and other components. A plurality of hooks 271 are so formed on the upper surface of the circuit case 27 as to protrude therefrom. In a state in which the circuit substrate 26 is sandwiched between the spacer 25 and the circuit case 27, the hooks 271 are caused to engage with the spacer 25. The spacer 25, the circuit substrate 26, and the circuit case 27 thus form an integrated unit.

B: Circuit Configuration of Electronic Apparatus Having Built-In Antenna

Figure 5:
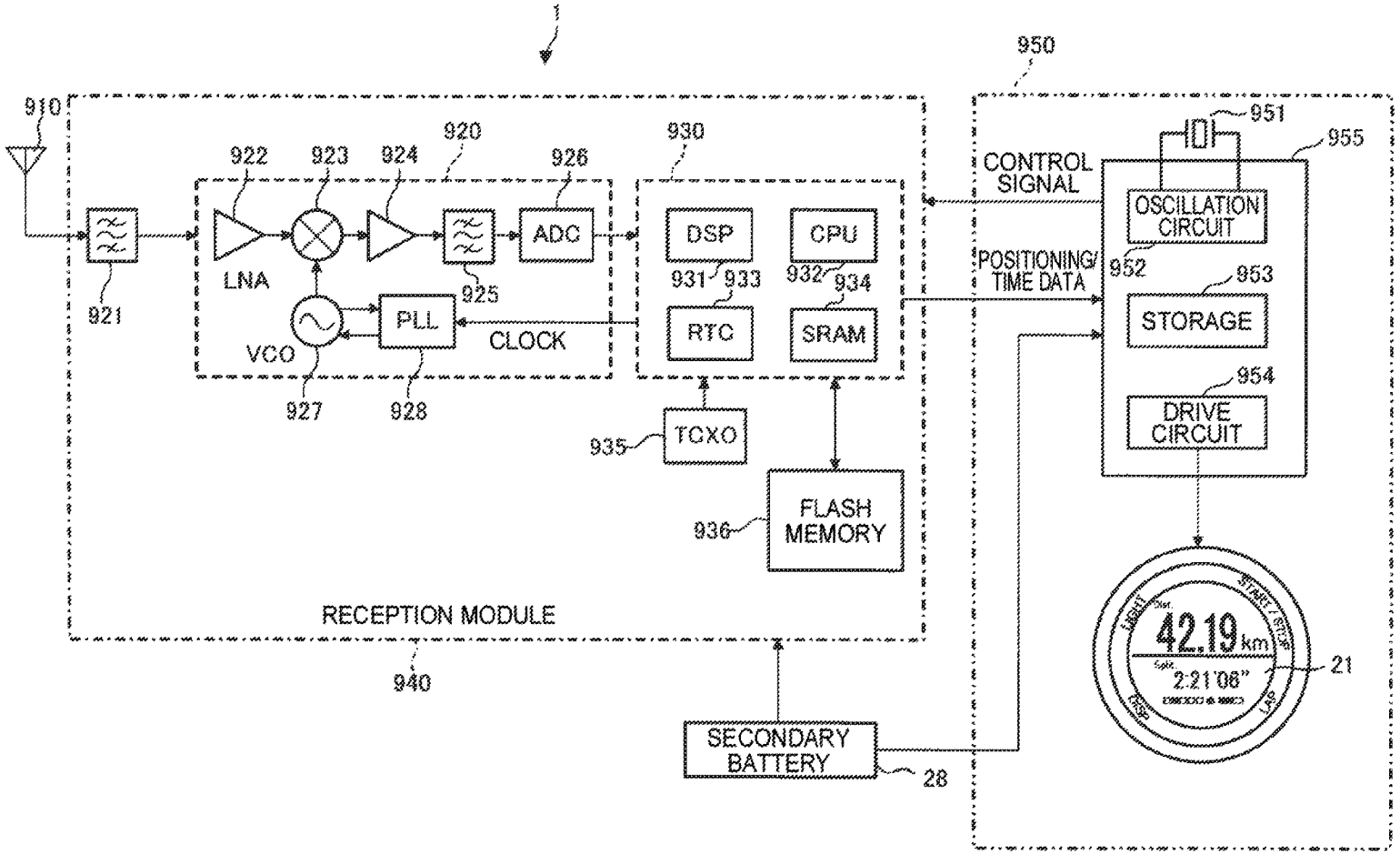
FIG. 5 is a block diagram showing the circuit configuration of the electronic apparatus.

The circuit configuration of the electronic apparatus 1 according to the present embodiment will next be described with reference to FIG. 5. The electronic apparatus 1 according to the present embodiment is configured to receive and use a positioning signal and other signals in the form of an electric wave from a GPS satellite.

Each of the GPS satellites 100 shown in FIG. 1 is a positional information satellite that goes along a predetermined orbit around the earth up in the sky and transmits, for example, a satellite signal formed of a 1.57542-GHz microwave with a navigation message superimposed thereon to the ground. Each of the GPS satellites 100 has an atomic clock incorporated therein, and the satellite signal contains GPS time information, which is very accurate time information measured with the atomic clock. The electronic apparatus 1, which functions as a GPS receiver, receives at least one satellite signal to correct a gain or delay of internal time and can display correct time. The correction is made in a time measurement mode.

A satellite signal further contains orbit information representing the position of the GPS satellite 100 on the orbit and other types of information. That is, the electronic apparatus 1 is further capable of positioning calculation and has, for example, a function of performing positioning calculation by receiving satellite signals transmitted typically from four or more GPS satellites and using the orbit information and GPS time information contained in the satellite signals. The positioning calculation allows the electronic apparatus 1 to readily correct or otherwise process time difference in accordance with the current position, and the correction is made in a positioning mode. The electric wave transmitted from a GPS satellite is a right-handed circularly polarized wave, which minimizes reception sensitivity variation due to the attitude of the reception antenna and time measurement and positioning errors due to a multipath phenomenon that occurs, for example, in a place between tall buildings.

In addition to the above, using satellite signals allows a variety of applications, such as current position display, travel distance measurement, and travel speed measurement, and the electronic apparatus 1 can digitally display the variety of pieces of information on the liquid crystal panel 21 of the display section 20. The electronic apparatus 1 includes push buttons 40, 41, 42, and 43, as shown in FIGS. 1 and 2, and the user operates the push buttons 40, 41, 42, and 43 to switch the information displayed on the liquid crystal panel 21 to another type of information and perform a variety of other types of control.

The circuit configuration of the electronic apparatus 1, which is an electronic wristwatch having the GPS reception function, will next be described. FIG. 5 is a block diagram for describing the electronic apparatus 1 according to the present embodiment. The electronic apparatus 1 includes an antenna section 910, a reception module (receiver) 940, a display section 950 including a controller (processor) 955, and a secondary battery 28, as shown in FIG. 5.

The reception module 940, to which the antenna section 910 is connected, includes a SAW (surface acoustic wave) filter 921, an RF (radio frequency) section 920, and a baseband section 930. The SAW filter 921 carries out the process of extracting a satellite signal from an electric wave received with the antenna section 910. The RF section 920 includes an LNA (low noise amplifier) 922, a mixer 923, a VCO (voltage controlled oscillator) 927, a PLL (phase locked loop) control circuit 928, an IF (intermediate frequency) amplifier 924, an IF filter 925, and an ADC (A/D converter) 926.

The satellite signal extracted by the SAW filter 921 is amplified by the LNA 922 and mixed by the mixer 923 with a local signal outputted by the VCO 927 to be down-converted into a signal that belongs to an intermediate frequency band. The PLL control circuit 928 and the VCO 927 form a phase locked loop in which a signal produced by frequency division of the local signal outputted by the VCO 927 is compared with a stable reference clock signal in terms of phase and the local signal is synchronized with the reference clock signal in accordance with phase comparison feedback for generation and stabilization of an accurate-frequency local signal. The mixture signal from the mixer 923 is amplified by the IF amplifier 924, and an unnecessary signal is removed from the amplified signal by the IF filter 925. The signal having passed through the IF filter 925 is converted into a digital signal by the ADC (A/D converter) 926.

The baseband section 930 includes a DSP (digital signal processor) 931, a CPU (central processing unit) 932, an SRAM (static random access memory) 934, and an RTC (real time clock) 933. Further, a temperature compensated crystal oscillator (TCXO) 935, a flash memory 936, and other components are connected to the baseband section 930.

The temperature compensated crystal oscillator (TCXO) 935 generates the reference clock signal having a roughly fixed frequency irrespective of temperature, and the flash memory 936 stores current position information, time difference information, and other types of information. When the time measurement mode or the positioning mode is set, the baseband section 930 carries out of the process of decoding a baseband signal from the converted digital signal outputted from the ADC 926 in the RF section 920. The baseband section 930 further acquires the orbit information, the GPS time information, and other types of satellite information contained in the navigation message from a captured GPS satellite 100 and stores the information in the SRAM 934.

The display section 950 includes a controller 955, a quartz oscillator 951, and other components. The controller 955 includes a storage 953, an oscillation circuit 952, and a drive circuit 954 and performs a variety of types of control. The controller 955 controls the reception module 940. The controller 955 transmits a control signal to the reception module 940 to control the reception action of the reception module 940. The controller 955 also controls display on the liquid crystal panel 21 via the drive circuit 954 in the controller 955. The storage section 953 stores a variety of types of information including internal time information. The secondary battery 28 supplies energy necessary for the circuit action and the display action.

The controller 955, the CPU 932, and the DSP 931 cooperate with one another to calculate time measurement information and positioning information and derive information on the time, the current position, the travel distance, the travel speed, and other parameters on the basis of the time measurement information and positioning information. The controller 955 further controls display of the derived information on the liquid crystal panel 21 and controls, for example, setting of the action mode and display mode of the electronic apparatus 1 in accordance with operation performed on the push buttons 40, 41, 42, and 43 shown in FIGS. 1 and 2. It is also possible to provide an advanced function, such as navigation in which the current position is displayed on a map.

C: Detailed Configuration of Antenna

The configuration of the antenna 30 in the electronic apparatus 1 according to the present embodiment will next be described in detail with reference to the accompanying drawings.

Figure 6:
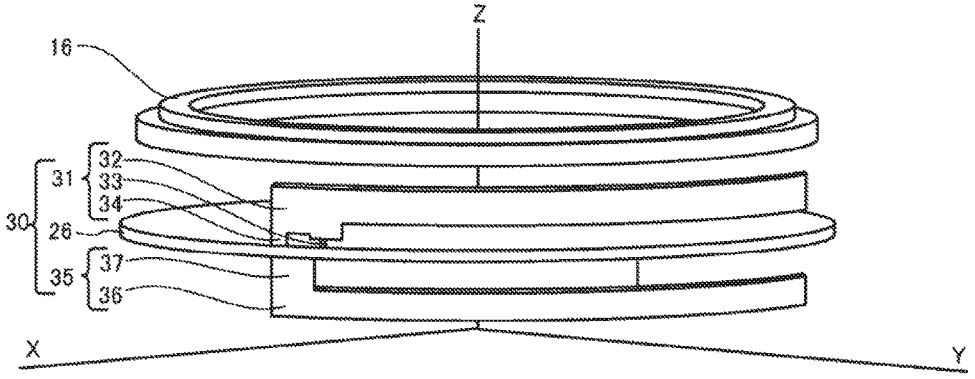
FIG. 6 is a diagrammatic view for describing the configuration of an antenna.
Figure 7:
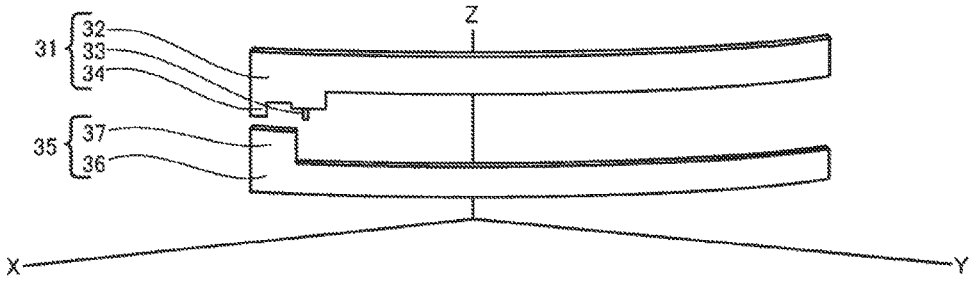
FIG. 7 is another diagrammatic view for describing the configuration of the antenna.

FIGS. 6 and 7 are diagrammatic views for describing the configuration of the antenna 30 in the present embodiment. As shown in FIG. 6, the antenna 30 in the present embodiment includes the first ribbon 31, which has an arcuate shape and serves as a first radiation element, the second ribbon 35, which has an arcuate shape and serves as a second radiation element, and the circuit substrate 26, which serves as the ground plate.

The first ribbon 31 includes the ribbon section 32, which has an arcuate shape, the power feeder 33, which has a linear shape, and the antenna electrode 34, which has a linear shape.

The ribbon section 32, the power feeder 33, and the antenna electrode 34 of the first ribbon 31 can be readily configured by using a copper wire, a pipe made, for example, of aluminum or silver, or any other component. It is preferable to use a metal having a small amount of resistance. A copper wire or a thin plate made, for example, of aluminum may instead be used. The components of the first ribbon 31 may instead be formed by attaching an electrically conductive foil on a base having an appropriate shape or in an etching process, a printing process, or any other process. The components of the first ribbon 31 may instead be formed by plating the inner wall of the case body 11. A structure in which a ribbon extends on a core member made, for example, of a plastic material can instead be employed.

The power feeder 33 and the antenna electrode 34 are connected to one end of the ribbon section 32, and the other end of the ribbon section 32 is a free end. The power feeder 33 and the antenna electrode 34 are connected to the circuit substrate 26. The power feeder 33 is connected to the signal pattern in the circuit substrate 26, and the antenna electrode 34 is connected to the GND pattern on the circuit substrate 26.

The first ribbon 31 is disposed on the side facing the side surface of the display section 20 in the internal space of the exterior case 2 and on the 6-o'clock side of the wristwatch, as shown in FIG. 4. A groove that is not shown is, for example, formed in the inner surface of the case body 11, which forms the exterior case 2, and the first ribbon 31 is accommodated in and held by the groove. The method for holding the first ribbon 31 is not limited to the method using a groove. For example, a plurality of projections that guide the first ribbon 31 may be provided on the inner surface of the case body 11, and the protrusions may hold the first ribbon 31.

The bezel 16 is made of a metal, such as stainless steel, titanium, aluminum, copper, and silver, and formed in a ring shape with no cutout (O-like shape). The bezel 16 is not necessarily made of a metal and can instead be formed by plating, for example, a resin material with a metal.

The first ribbon 31 of the antenna 30 in the present embodiment has the same configuration as in a case where a dipole antenna sufficiently shorter than 1λ is bent to form an arcuate loop element (magnetic current element) as the ribbon section 32 and a linear element (electric current element) as the antenna electrode 34 and the power feeder 33 is used to feed the ribbon section 32 and the antenna electrode 34 with electric power.

The first ribbon 31 is disposed in a position where the first ribbon 31 overlaps with the bezel 16 in a plan view, as shown in FIG. 2, disposed below the bezel 16 in the upward/downward direction (the direction perpendicular to the plane of view of FIG. 2, the direction in which the display section 20 performs display), and separated from the bezel 16 as a passive element by a predetermined distance.

The configuration described above allows the bezel 16 to be electromagnetically coupled with the first ribbon 31. In the present embodiment, the electromagnetically coupled bezel 16 is used as an extension of the linear element (electric current element), as will be described later.

The power feeder 33, which moves a feeding point, is connected to the first ribbon 31. The antenna electrode 34 is connected to the GND pattern on the circuit substrate 26, and the power feeder 33 is connected to the signal pattern in the circuit substrate 26. In the configuration described above, the antenna electrode 34 and the bezel 16 operate as an electric current element that being a source of an electric current vector, and the ribbon section 32 operates as a magnetic current element that issues a magnetic current vector. That is, the circuit substrate 26 functions as the GND plate, and the circuit substrate 26 is disposed below the first ribbon 31 in the upward/downward direction described above.

In the electronic apparatus 1 according to the present embodiment as a wristwatch, to satisfy visibility of the display section and portability of the timepiece, the exterior shape of the exterior case in a plan view of the wristwatch preferably has a diameter greater than or equal to about 20 mm but smaller than or equal to about 50 mm. The bezel 16 has no cutout, unlike the first ribbon 31, and is a closed-O-shaped ring. In the present embodiment, the bezel 16 has a diameter of 30 mm by way of an example. The perimeter of the bezel 16 is therefore about 90 mm.

However, since the bezel 16 is an O-shaped ring with not cutout, current symmetrically flows through the bezel 16, and the bezel 16 does not therefore function as a loop element. That is, even if electric power is fed to a single point of the bezel 16, current flows in opposite directions from the feeding point. The bezel 16 is therefore considered to be equivalent to a single linear element, and the equivalent electrical length of the bezel 16 is not the perimeter thereof but is a length close to the diameter thereof.

The electronic apparatus 1 according to the present embodiment receives a GPS electric wave having a frequency of about 1.5 GHz and a wavelength (1λ) of about 200 mm, as described above. The equivalent electrical length of the bezel 16 is therefore sufficiently shorter than 1λ. In the antenna 30 in the present embodiment, the sum of the equivalent electrical length of the bezel 16, the equivalent electrical length of the first ribbon 31, and the equivalent electrical length of the antenna electrode 34 is set at ¼λ.

The second ribbon 35 includes the ribbon section 36, which has an arcuate shape, and the antenna electrode 37, which has a linear shape.

The ribbon section 36 and the antenna electrode 37 of the second ribbon 35 can be readily configured by using a copper wire or a pipe made, for example, of aluminum or silver, as in the case of the first ribbon 31. It is preferable to use a metal having a small amount of resistance. A copper wire or a thin plate made, for example, of aluminum may instead be used. The ribbon section 36 and the antenna electrode 37 may instead be formed by attaching an electrically conductive foil on a base having an appropriate shape or in an etching process, a printing process, or any other process. The ribbon section 36 and the antenna electrode 37 may instead be formed by plating the inner wall of the case body 11 with a metal. A structure in which a ribbon extends on a core member made, for example, of a plastic material can instead be employed.

The antenna electrode 37 is connected to one end of the ribbon section 36, and the other end of the ribbon section 36 is a free end. The antenna electrode 37 is connected to the GND pattern on the circuit substrate 26.

The second ribbon 35 is provided not only in a position where the first ribbon 31 and the second ribbon 35 are symmetric with respect to the circuit substrate 26 but also in the position of an electric image of the first ribbon 31, as shown in FIG. 6. That is, the second ribbon 35 is disposed along the direction of the current produced by the first ribbon 31 and flowing through the circuit substrate 26. It is noted that the second ribbon 35 is not necessarily disposed along the direction of the current in the circuit substrate 26 and may instead be disposed along the direction of the current theoretically flowing outside the circuit substrate 26. The second ribbon 35 only needs to be disposed roughly along the direction of an intense current portion of the current distribution.

The antenna electrode 37 of the second ribbon 35 is connected to the GND pattern on the circuit substrate 26. Specifically, the antenna electrode 37 is connected to a position where the antenna electrode 37 electrically shares the point where the antenna electrode 34 of the first ribbon 31 is grounded. The first ribbon 31 is provided with the power feeder 33, but the second ribbon 35 is provided with no power feeder because no electric power needs to be fed to the second ribbon 35. The second ribbon 35 is therefore an L-shaped ribbon.

A groove that is not shown is, for example, formed in the inner surface of the case body 11, which forms the exterior case 2, and the second ribbon 35 is accommodated in and held by the groove. The method for holding the second ribbon 35 is not limited to the method using a groove. For example, a plurality of projections that guide the second ribbon 35 may be provided on the inner surface of the case body 11, and the projections may hold the second ribbon 35.

When the circuit substrate 26 as the GND plate is sufficiently large, an image antenna is formed in a position where the first ribbon 31 and the image antenna are symmetric with respect to the circuit substrate 26. That is, since the second ribbon 35 is connected to a position where the antenna electrode 37 electrically shares the point where the antenna electrode 34 of the first ribbon 31 is grounded, and the second ribbon 35 is provided in a position where the first ribbon 31 and the second ribbon 35 are symmetric with respect to the circuit substrate 26, the second ribbon 35 functions as an actually existing image antenna.

Further, in the present embodiment, the sum of the equivalent electrical length of the bezel 16 and the equivalent electrical length of the first ribbon 31 is set at ¼λ, and the equivalent electrical length of the second ribbon 35 is also set at ¼λ. The antenna 30 in the present embodiment therefore operates as an antenna having an equivalent electrical length of ½λ, as in the case of a ground plane antenna.

As described above, in the present embodiment, the display section 20 and the antenna 30 are accommodated in the exterior case 2, and the exterior case 2 includes the case back 12. The bezel 16 as a passive element is positioned on the opposite side of the display section 20 with respect to the case back 12. Further, the first ribbon 31 as the first radiation element is positioned between the bezel 16 and the case back 12. In place of the bezel 16, a metal-containing member that functions as a passive element may be provided above the display section 20. When a metal-containing member that functions as a passive element may be provided above the display section 20, the passive element is still positioned on the opposite side of the display section 20 with respect to the case back 12. Further, the first ribbon 31 as the first radiation element is still positioned between the passive element and the case back 12.

Figure 18A:
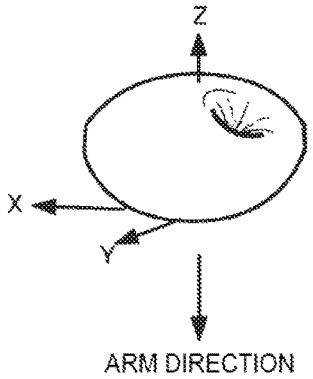
FIG. 18A is a diagrammatic view for describing the directivity of an antenna in Comparative Example.
Figure 18B:
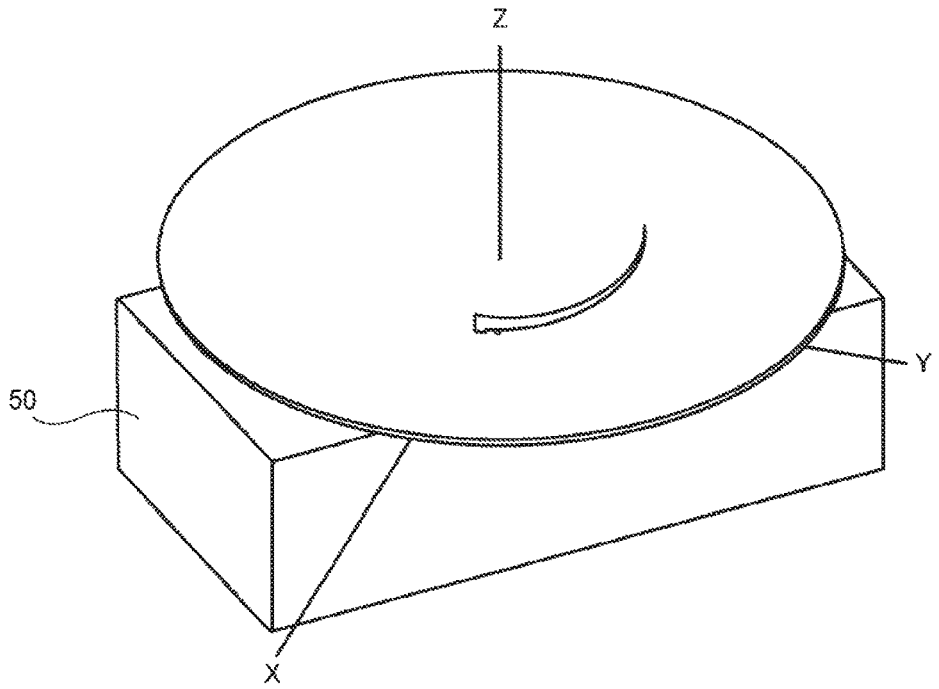
FIG. 18B is a diagrammatic view for describing an antenna and a circuit substrate in Comparative Example.

The directivity of the antenna 30 in the present embodiment will next be described. The description will first be made of the directivity in a case where only the first ribbon 31 is used. Transmission and reception performed by the antenna are the same phenomenon but only differ from each other in that the ± signs are reversed, and the following description will therefore be made of transmission for simplification of the description. In a case where the circuit substrate 26 as the GND plate is sufficiently larger than the first ribbon 31, as shown in FIG. 18B, when the electronic apparatus 1 provided only with the first ribbon 31 as an antenna is worn around an arm, ideal directivity having a roughly horizontal-donut-like shape is still provided, as shown in FIG. 18A. That is, the directivity in the arm direction decreases, and electric power absorbed by the arm therefore decreases, whereby no degradation in sensitivity occurs. In the example shown in FIG. 18B, the circuit substrate 26 is assumed to have a diameter of 90 mm as the GND plate. Further, a box-shaped body 50 shown in FIG. 18B represents the arm in a pseudo shape.

Figure 19A:
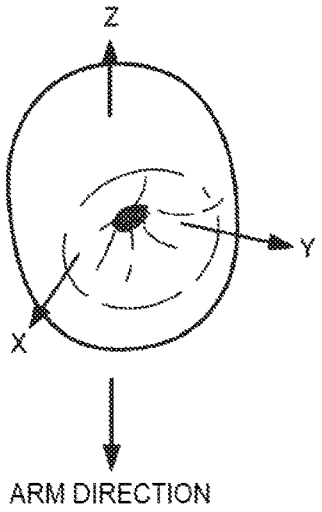
FIG. 19A is a diagrammatic view for describing the directivity of an antenna in Comparative Example.
Figure 19B:
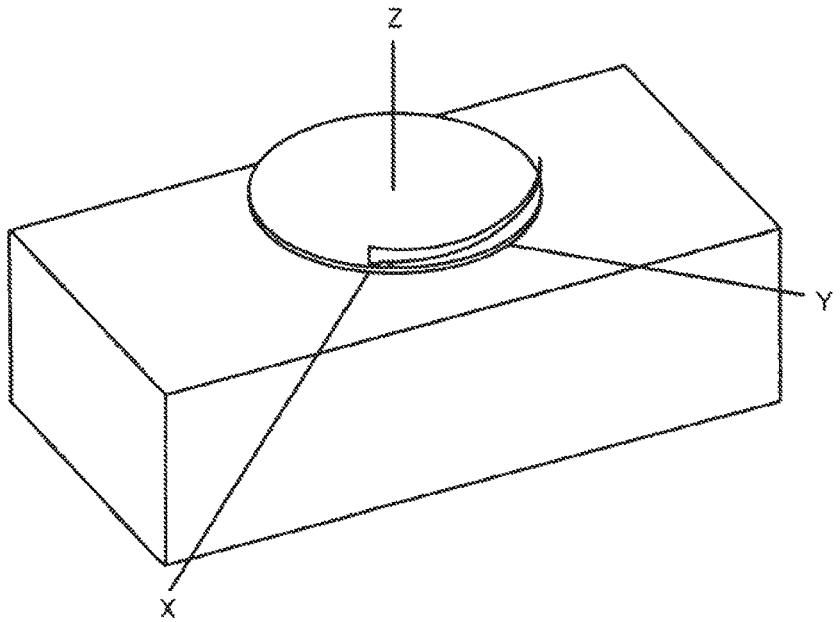
FIG. 19B is a diagrammatic view for describing an antenna and a circuit substrate in Comparative Example.

On the other hand, in a case where the GND plate has, for example, a diameter of about 40 mm, which is the diameter of the circuit substrate 26 used in a wristwatch, as shown in FIG. 19B, when the electronic apparatus 1 provided only with the first ribbon 31 as an antenna is worn around an arm, the directivity is oriented in the direction of the arm, as shown in FIG. 19A, and the electric power oriented in the direction of the arm is absorbed by the arm, resulting in degradation in radiation efficiency of the antenna.

Figure 20:
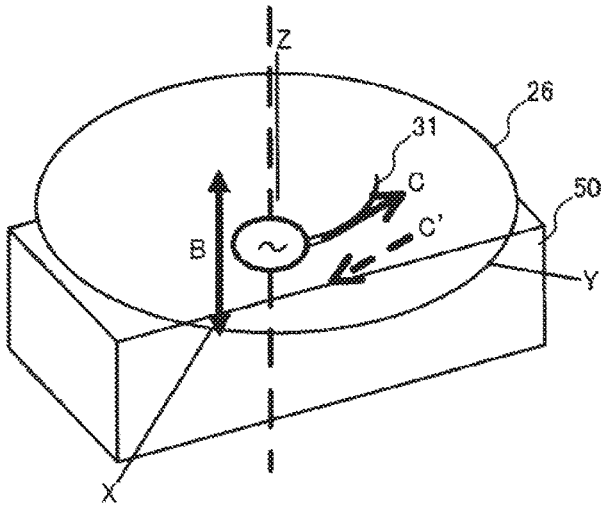
FIG. 20 is a diagrammatic view for describing current flowing through an antenna and a circuit substrate in Comparative Example.

When the GND plate is sufficiently large, the current flowing through the first ribbon 31 in the direction labeled with the arrow C in FIG. 20, that is, in the direction parallel to the arm is canceled by the current flowing through the circuit substrate 26 in the direction labeled with the arrow C'. Only the current flowing in the upward/downward direction labeled with the arrow B is therefore present, and an image antenna appears in such a way that the first ribbon 31 and the image antenna are symmetric with respect to the circuit substrate 26. The directivity of the antenna therefore has a shape close to the ideal horizontal-donut-like shape, as shown in FIG. 18A.

Figure 21:
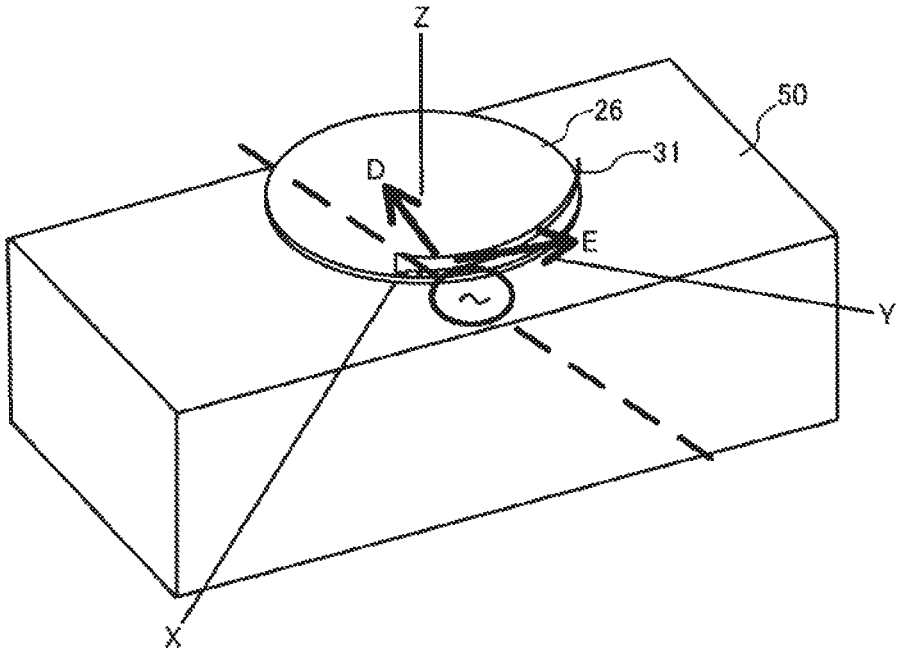
FIG. 21 is a diagrammatic view for describing current flowing through an antenna and a circuit substrate in Comparative Example.

When the GND plate is not sufficiently large, however, the current distribution is biased toward one side of the first ribbon 31 (inside circuit substrate 26), as indicated by the arrows D and E in FIG. 21, and the current parallel to the arm is not canceled, unlike the case where the GND plate is sufficiently large. Therefore, in the case where only the first ribbon 31 is used, it is believed that the shape of the image antenna deteriorates, and the action of the antenna 30 undesirably approaches the action of a dipole antenna placed in the direction parallel to the arm instead of the action of a ground plane antenna. The directivity of the antenna is therefore oriented in the direction of the arm, as shown in FIG. 19A, and the electric power oriented in the direction of the arm is absorbed by the arm, resulting in degradation in the sensitivity.

Figure 8:
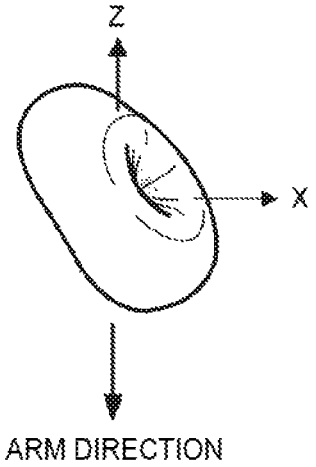
FIG. 8 is a diagrammatic view for describing the directivity of the antenna.

In contrast, in the present embodiment, the second ribbon 35 is actually provided in the position corresponding to the image antenna, as shown in FIG. 6, allowing the action mode in the case where the GND plate is small to approach the action mode in the case where the GND plate is sufficiently large. The second ribbon 35 provided in the position corresponding to the image antenna allows the directivity to incline and approach horizontal directivity as shown in FIG. 8, and electric power absorbed by the arm therefore decreases, whereby degradation in the sensitivity can be avoided.

The size of the antenna 30 in the present embodiment will next be described. In the case where a GPS electric wave has the frequency of about 1.5 GHz, 1λ is about 200 mm, and ¼λ, which is the equivalent electrical length of the antenna 30, is therefore about 50 mm. However, λ in the above description is the wavelength in a free space and is actually set within a predetermined range due, for example, to effects of members around the antenna. For example, in the present embodiment, the equivalent electrical length of the antenna 30 is set within a range from 0.8×(¼λ) to 1.3×(¼λ), that is, from 40 to 65 mm by way of example.

Figure 9:
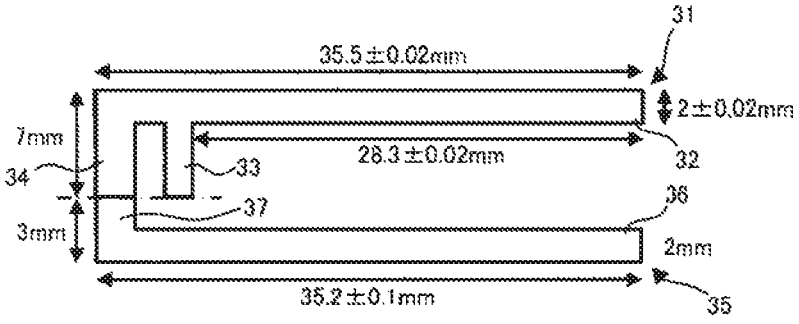
FIG. 9 is a diagrammatic view for describing the size of the antenna.

The first ribbon 31 used in the present embodiment is configured by way of example as follows: The width of the ribbon section 32 is 2 mm; the length of the ribbon section 32 is 35.5 mm; and the length of the antenna electrode 34 is 7 mm, as shown in FIG. 9. The length of the ribbon section 32 is ¼λ×0.85 when the ¼λ is set at about 50 mm. The thickness of the first ribbon 31 is 100 μm.

The equivalent electrical length of the bezel 16 is 45 mm, which is approximately half of the perimeter of the bezel 16, because current flows in principle symmetrically with respect to a predetermined line passing through the diameter of the bezel 16. The bezel 16 is, however, disposed in a position where the bezel 16 overlaps with the first ribbon 31 in a plan view of the wristwatch. The portion that forms the thus disposed bezel 16 and overlaps with the first ribbon 31 in a plan view of the wristwatch (hereinafter referred to as overlapping portion) functions as the equivalent electrical length of the antenna 30 in such a way that both the equivalent electrical length of the first ribbon 31 and the equivalent electrical length of the bezel 16 contribute to the equivalent electrical length of the antenna 30. In the present embodiment, since the length of the overlapping portion is about 35 mm, the effective equivalent electrical length of the bezel 16 is about 10 mm.

Therefore, in the present embodiment, the sum of the equivalent electrical length of the bezel 16, the length of the ribbon section 32 of the first ribbon 31, and the length of the antenna electrode 34 of the first ribbon 31 is set at about 52.5 mm, which is 1.15×(¼λ).

The second ribbon 35 used in the present embodiment is configured by way of example as follows: The width of the ribbon section 36 is 2 mm; the length of the ribbon section 36 is 35.2 mm; and the length of the antenna electrode 37 is 3 mm, as shown in FIG. 9. The thickness of the second ribbon 35 is 100 μm. The length of the ribbon section 36 is ¼λ×0.76 when the ¼λ is set at about 50 mm.

Figure 10:
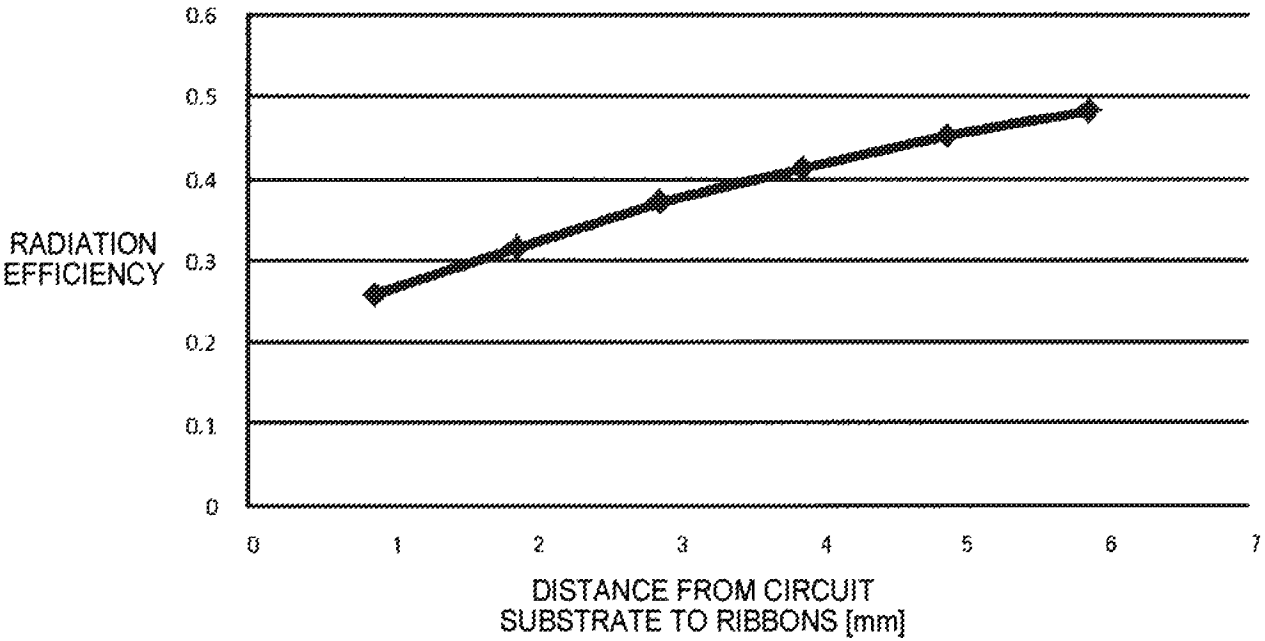
FIG. 10 is a graph showing the relationship between radiation efficiency versus the distances from a circuit substrate to ribbons.

The distances from the circuit substrate 26 to the ribbon sections 32 and 36, that is, the lengths of the antenna electrodes 34 and 37 are related to the radiation efficiency as shown in FIG. 10. Since the first ribbon 31 and the second ribbon 35 have a fixed overall length (about ¼ of wavelength), the shorter the ribbon sections 32 and 36, which are the horizontal portions of the first ribbon 31 and the second ribbon 35, the longer the antenna electrodes 34 and 37, which are the vertical portions thereof. When the ribbon sections 32 and 36, which are the horizontal portions, have a length of zero, the lengths of the antenna electrodes 34 and 37, that is, the distances from the circuit substrate 26 to the ribbon sections 32 and 36 have upper limit values. On the other hand, the radiation efficiency monotonously increases as the lengths or the distances approach the upper limits, as shown in FIG. 10.

When the magnitude of an electric field produced by the antenna electrodes 34 and 37, which are the vertical portions of the first ribbon 31 and the second ribbon 35, is roughly equal to the magnitude of an electric field produced by the ribbon sections 32 and 36, which are the horizontal portions thereof, the magnitude of the circularly polarized wave is maximized in principle. The radiation efficiency is therefore maximized when the antenna electrodes 34 and 37, which are the vertical portions, have a length equal to the length of the ribbon sections 32 and 36, which are the horizontal portions. For example, in the case where ¼λ is set at about 50 mm, the radiation efficiency is maximized when the ribbon sections 32 and 36 have a length of 25 mm and the antenna electrodes 34 and 37 have a length of 25 mm.

However, in the case of a wristwatch-type electronic apparatus, for example, since the height of the electronic apparatus is about 10 mm, the lengths of the antenna electrodes 34 and 37 cannot be set at 25 mm. The lengths of the antenna electrodes 34 and 37, that is, the distances from the circuit substrate 26 to the ribbon sections 32 and 36 are therefore set at values ranging from about 3 to 7 mm, as in the present embodiment.

These lengths can be determined by using a moment method or any other simulation.

Figure 11:
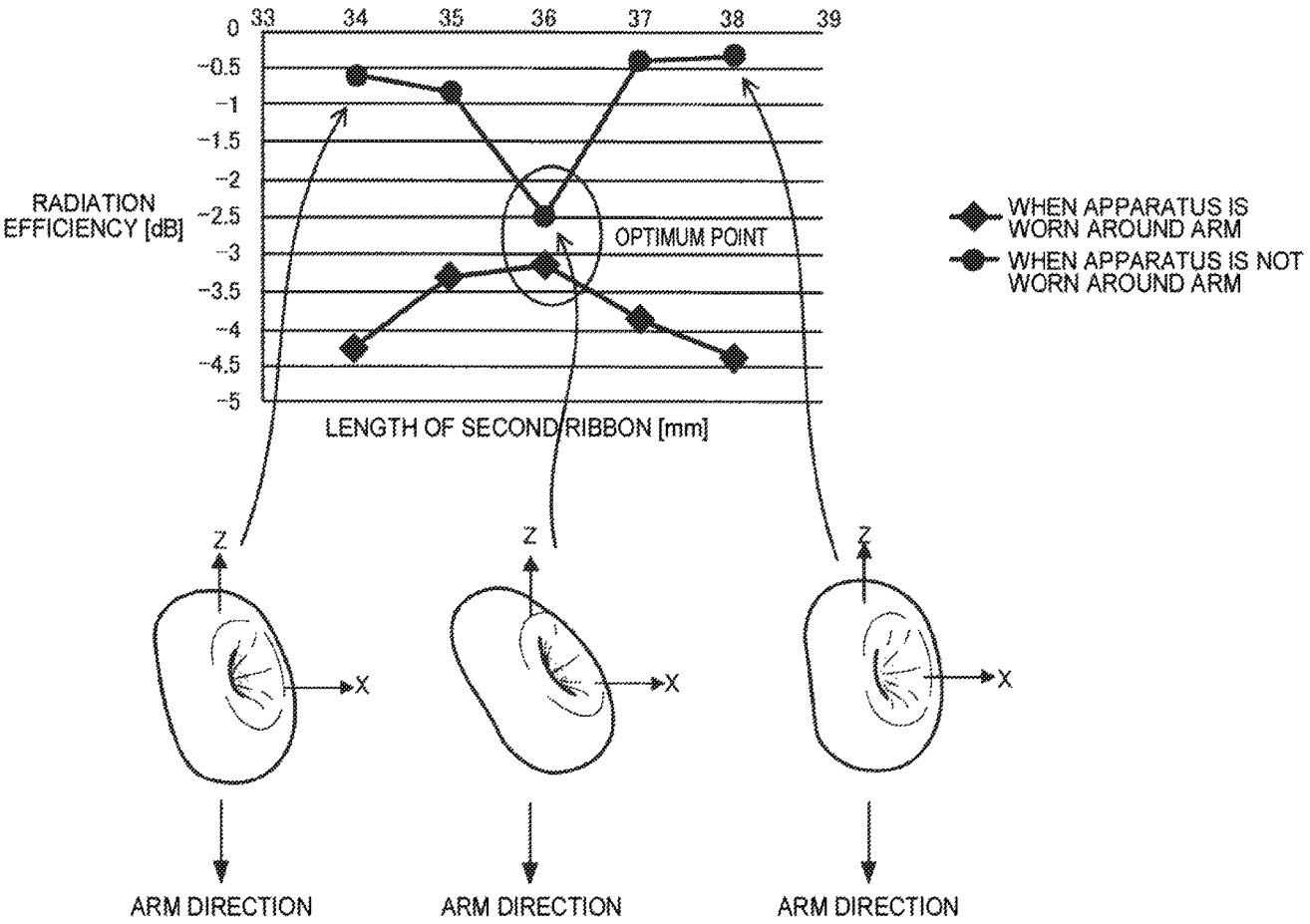
FIG. 11 shows the relationship between radiation efficiency and directivity versus the length of a second ribbon.

Further, the length of the ribbon section 36 of the second ribbon 35 is related to the radiation efficiency and the directivity as shown in FIG. 11. When the length of the ribbon section 36 of the second ribbon 35 is changed, the directivity changes, and in the case where the electronic apparatus 1 is worn around an arm, the radiation efficiency is maximized when the length of the ribbon section 36 is 36 mm, as shown in FIG. 11. Further, in this case, the directivity most approaches the horizontal direction, and the directivity in the arm direction is therefore minimized. That is, since the directivity in the arm direction is minimized, electric power absorbed by the arm is minimized, whereby the radiation efficiency is maximized.

In the present embodiment, since the length of the ribbon section 36 of the second ribbon 35 is set at about 35.2 mm as described above, the radiation efficiency can be greatly improved to as high as 50%, whereas the radiation efficiency is 30% when only the first ribbon 31 is used.

As described above, according to the present embodiment, in which the second ribbon 35, which is an image antenna of the first ribbon 31, which is an inversed-F-shaped antenna, is actually provided, the directivity in the arm direction can be reduced for improvement in the radiation efficiency even when the circuit substrate 26 as the GND plate cannot be sufficiently enlarged, whereby a decrease in the sensitivity can be avoided.

In the present embodiment, the center position of each of the first ribbon 31 and the second ribbon 35 is located in the vicinity of the 5-o'clock position, as shown in FIG. 2, but the present disclosure is not limited to this configuration. For example, the center position of each of the first ribbon 31 and the second ribbon 35 may instead be located in the vicinity of the 6-o'clock position.

Second Embodiment

A second embodiment of the present disclosure will next be described with reference to FIG. 12. In the following description, configurations common to those in the first embodiment have the same reference characters, and no redundant description will be made. The first embodiment has been described with reference to the configuration in which the second ribbon 35 is provided in the position of an image of the first ribbon 31, that is, in the position where the first ribbon 31 and the second ribbon 35 are symmetric with respect to the circuit substrate 26. In the present embodiment, however, the second ribbon 35 is provided on the side where the first ribbon 31 is provided.

Figure 12:
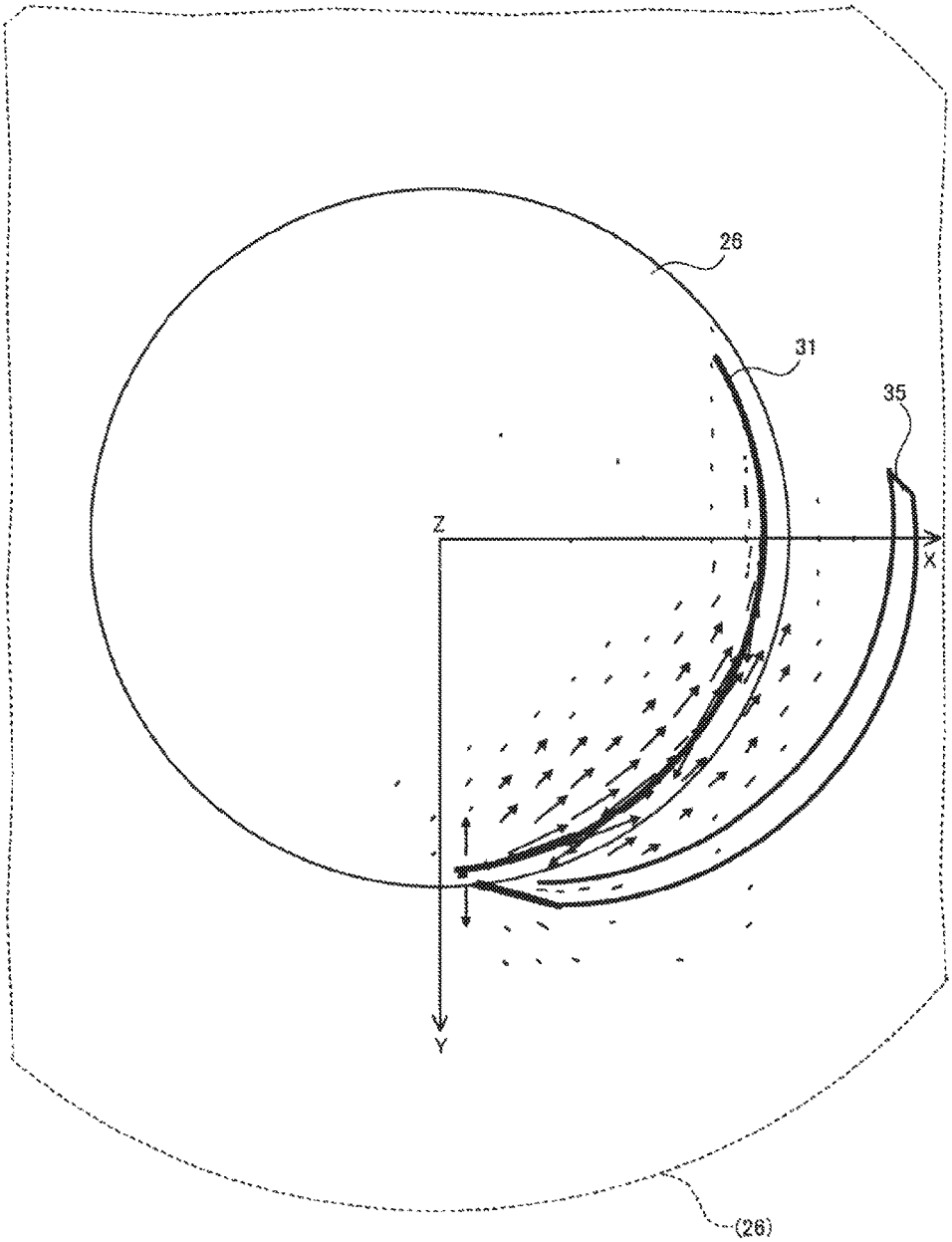
FIG. 12 is a diagrammatic view for describing the configuration of an antenna according to a second embodiment.

When the circuit substrate 26 is sufficiently large, as indicated by the dotted line in FIG. 12, the current is distributed on the circuit substrate 26 as indicated by the arrows. When the size of the circuit substrate 26 decreases, as indicated by the solid line in FIG. 12, part of the current indicated by the arrows is distributed inside the circuit substrate 26 indicated by the solid line, but the other part of the current indicated by the arrows is distributed outside the circuit substrate 26 indicated by the solid line. That is, the other part of the current so indicated as to be located outside the circuit substrate 26 does not exist as the current flowing on the circuit substrate 26 indicated by the solid line.

To handle the situation described above, in the present embodiment, the second ribbon 35 provided on the side where the first ribbon 31 is present compensates the missing current distribution in the case where the circuit substrate 26 cannot be sufficiently enlarged.

The length of the second ribbon 35 is set at a value close to ¼λ as in the first embodiment to allow the second ribbon 35 to resonate at the frequency of the antenna. The magnitude of the current flowing through the finite-length second ribbon 35 can therefore be maximized. In the present embodiment, the distribution of the current located outside the circuit substrate 26 as described above is reproduced by the current flowing through the second ribbon 35.

Therefore, as in the case where the circuit substrate 26 is sufficiently large, the directivity in the arm direction can be reduced and electric power consumed by the arm can therefore be reduced, whereby a decrease in the sensitivity can be avoided.

Further, in the first embodiment, the second ribbon 35 is provided in roughly the same position as that of the first ribbon 31 in a plan view, but the position of the second ribbon 35 does not necessarily coincide with the position of the first ribbon 31 in a plan view, as in the present embodiment. The reason for this is that the distribution of the current located outside the circuit substrate 26 because the circuit substrate 26 is small only needs to be reproduced by the second ribbon 35.

Further, the second ribbon 35 may be positioned inside the first ribbon 31 in a plan view. When the second ribbon 35 is positioned inside the first ribbon 31, the distribution of the current located outside the circuit substrate 26 is produced in positions inside the circuit substrate 26. The same advantageous effect is provided also in this case.

Moreover, the position of the second ribbon 35 in the Z direction in FIG. 12 may be higher than the position of the first ribbon 31. When the second ribbon 35 is located in a position higher than the first ribbon 31, the distribution of the current located on the circuit substrate 26 is produced above the circuit substrate 26. The same advantageous effect is provided also in this case.

In the present embodiment, the second ribbon 35 may be provided in the position where the first ribbon 31 and the second ribbon 35 are symmetric with respect to the circuit substrate 26, as in the first embodiment. Even when the second ribbon 35 is provided in the position where the first ribbon 31 and the second ribbon 35 are symmetric with respect to the circuit substrate 26, the second ribbon 35 may be located outside the circuit substrate 26 or inside the first ribbon 31 in a plan view.

In either case, the second ribbon 35 as the second radiation element is preferably disposed at a location where the density of theoretically flowing current is high. In the present embodiment, the second ribbon 35 is disposed along the direction of the current produced by the first ribbon 31 as the first radiation element and flowing on the circuit substrate 26. The second ribbon 35 is not necessarily disposed along the direction of the current in the circuit substrate 26 and may be disposed along the direction of current theoretically flowing outside the circuit substrate 26. The second ribbon 35 only needs to extend roughly along the direction of an intense current portion in the current distribution. It is important to set the points where the first ribbon 31 and the second ribbon 35 are grounded are located in electrically shared positions, as in the first embodiment. For example, providing the grounding points in the vicinity of the edge of the circuit substrate 26 allows the grounding points to be close to each other and hence electrically shared.

Third Embodiment

A third embodiment of the present disclosure will next be described with reference to FIG. 13. In the following description, configurations common to those in the first and second embodiments have the same reference characters, and no redundant description will be made. In the embodiments described above, the configuration using the bezel 16 made of a metal has been described, but the bezel 16 made of a metal is not used in the configuration of the present embodiment.

When the bezel 16 made of a metal is used, an element symmetric with respect to the circuit substrate 26 is required as an image of the bezel 16 in an exact sense. A configuration in which no bezel made of a metal is used, as shown in FIG. 13, can therefore more prominently provide the advantageous effect of the present disclosure. For example, when the bezel 16 made of a metal and the second ribbon 35 are used, the radiation efficiency is −3.3 dB (46%), whereas when the bezel 16 made of a metal is not used but the second ribbon 35 is used, the radiation efficiency is −3.1 dB (48%). When the bezel 16 made of a metal is used but the second ribbon 35 is not used, the radiation efficiency is −4.5 dB (35%), whereas when the bezel 16 made of a metal or the second ribbon 35 is not used, the radiation efficiency is −4.8 dB (33%).

Figure 13:
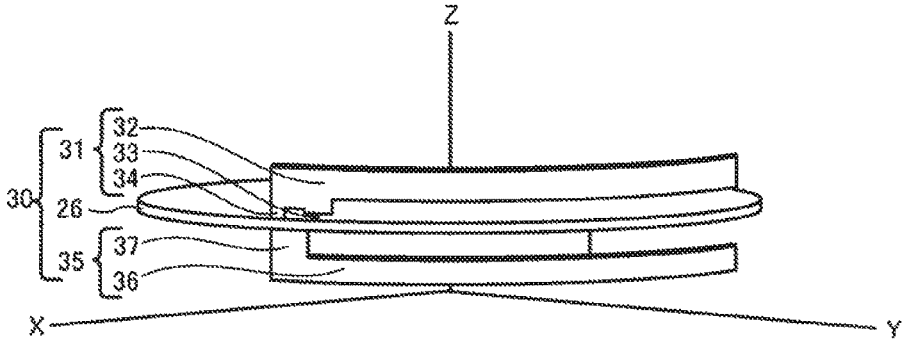
FIG. 13 is a diagrammatic view for describing the configuration of an antenna according to a third embodiment.

The example shown in FIG. 13, which corresponds to FIG. 6 in the first embodiment, differs from the first embodiment in that the bezel 16 made of a metal is not provided.

The case where no bezel made of a metal is used includes a case where a bezel made of a plastic material is used and a case where a bezel itself is not used.

According to the present embodiment, in which the second ribbon 35, which is an image antenna of the first ribbon 31, which is an inversed-F-shaped antenna, is actually provided, the directivity in the arm direction can be reduced for improvement in the radiation efficiency even when the circuit substrate 26 as the GND plate cannot be sufficiently enlarged, whereby a decrease in the sensitivity can be avoided.

Fourth Embodiment

Figure 14:
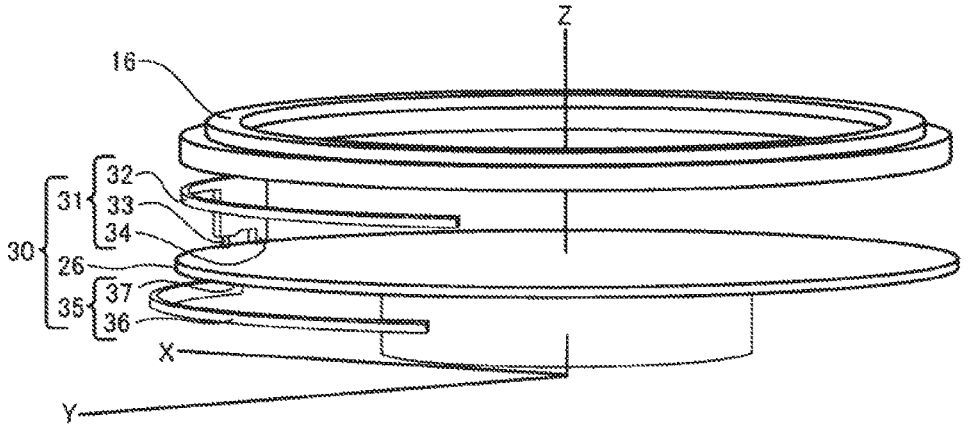
FIG. 14 is a diagrammatic view for describing the configuration of an antenna according to a fourth embodiment.

A fourth embodiment of the present disclosure will next be described with reference to FIG. 14. In the following description, configurations common to those in the first to third embodiments have the same reference characters, and no redundant description will be made. In the embodiments described above, the configuration using the plate-shaped ribbons has been described, but wire-shaped ribbons are used in the configuration of the present embodiment.

In the embodiments described above, the first ribbon 31 and the second ribbon 35 are formed by using thin-plate-shaped metal in primary consideration of convenience in manufacturing. The ribbons can be manufactured at low cost with high dimensional precision by simply cutting a large metal plate into the shape of the ribbons, for example, in press working. Further, since a relatively large area is provided, the area where current produced by a skin effect flows can be enlarged, allowing reduction in resistance per unit length of the ribbons, whereby the radiation efficiency can be improved by about 0.1 to 0.3 dB.

On the other hand, the width of the ribbons described above cannot be provided in some cases depending on the shape of the enclosure of the apparatus. In this case, each of the first ribbon 31 and the second ribbon 35 can be formed by using a wire having a square, circular, or any other cross-sectional shape, as shown in FIG. 14, in place of the plate-shaped ribbons. In the configuration shown in FIG. 14, since the area where the current produced by the skin effect flows decreases, the sensitivity slightly lowers only to the extent that the decrease does not affect practical use of the apparatus. When each of the ribbons is formed of a wire, the material of the wire is preferably a metal having a small amount of resistance. For example, copper, aluminum, and silver can be used.

Also in the present embodiment, the bezel 16 made of a metal may not be used, as in the third embodiment.

Fifth Embodiment

A fifth embodiment of the present disclosure will next be described with reference to FIG. 15. In the following description, configurations common to those in the first to fourth embodiments have the same reference characters, and no redundant description will be made. In the embodiments described above, the configuration using the arcuate second ribbon 35 has been described, but a second ribbon 35 part of which is bent is used in the present embodiment.

Figure 15:
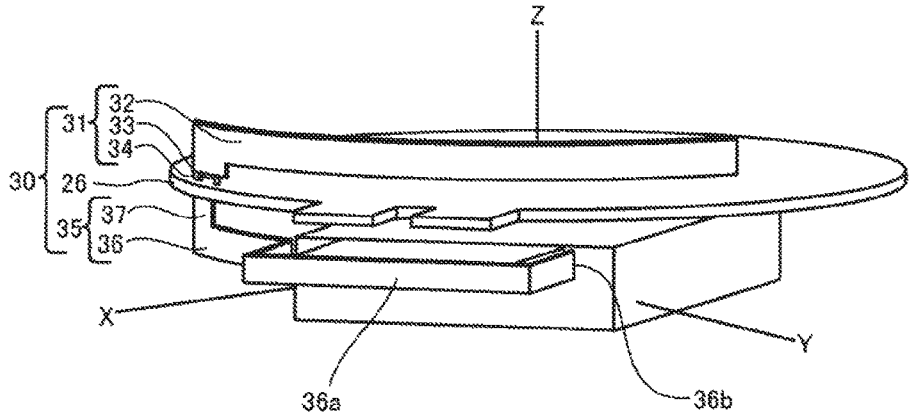
FIG. 15 is a diagrammatic view for describing the configuration of an antenna according to a fifth embodiment.

FIG. 15 is a perspective view showing a schematic configuration of an antenna 30 in the present embodiment. The second ribbon 35 as the second radiation element in the present embodiment has a bent section **36*a* as a part of the ribbon, as shown in FIG. 15. Even when part of the second ribbon 35 forms the bent section 36*a*, the same advantageous effect provided by the embodiments described above can be provided as long as the direction from an end portion that is part of the antenna electrode 37 of the second ribbon 35 and connected to a grounding point to a free end portion 36*b* of the second ribbon 35 coincides with the direction of the current produced by the first ribbon 31 and flowing on the circuit substrate 26. The second ribbon 35 is not necessarily disposed along the direction of the current in the circuit substrate 26 and may be disposed along the direction of the current theoretically flowing outside the circuit substrate 26. The second ribbon 35 only needs to extend roughly along the direction of an intense current portion of the current distribution. Also in the present embodiment, the second ribbon 35 is preferably disposed at a location where the density of theoretically flowing current is high. According to the present embodiment, in which part of the second ribbon 35 forms the bent section 36*a*, the configuration of the antenna according to the present disclosure can be achieved even when it is difficult to dispose the arcuate second ribbon 35**.

Sixth Embodiment

A sixth embodiment of the present disclosure will next be described with reference to FIG. 16. In the following description, configurations common to those in the first to fifth embodiments have the same reference characters, and no redundant description will be made. In the first embodiment, the present disclosure is applied to a digital running watch as an example of the electronic apparatus. In the present embodiment, the present disclosure is applied to an analog GPS watch as an example of the electronic apparatus.

Figure 16:
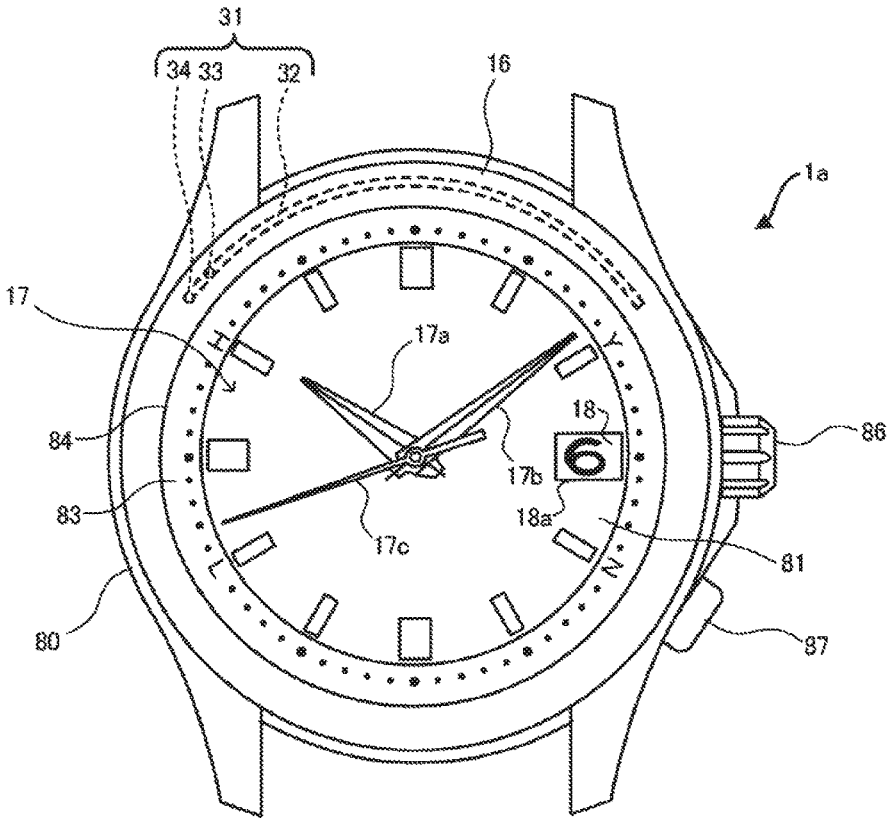
FIG. 16 is a plan view of an electronic apparatus according to a sixth embodiment.

An electronic apparatus 1*a* according to the present embodiment shown in FIG. 16 is an electric wave correction timepiece that is driven with electric power generated with a solar panel and receives GPS signals for time correction. The electronic apparatus 1*a* includes an exterior case 80. The exterior case 80 is a cylindrical case made of a metal. A bezel 16 made of a metal is fit into the exterior case 80.

A disk-shaped dial 81 is disposed as a time display section on the inner circumferential side of the bezel 16 via a ring-shaped dial ring 83 made of a plastic material, and indication hands 17, which display time and other types of information, are disposed on the dial 81. The indication hands 17 are formed of an hour hand 17*a*, a minute hand 17*b*, and a second hand 17*c*. A date recognition window 18*a* is formed as an opening in the dial 81, and a date displayed on a date indicator 18 is visible through the date recognition window 18*a*.

A front-surface-side opening of the exterior case 80 is closed by a cover glass plate 84 via the bezel 16, and the dial 81 and the indication hands 17 (hour hand 17*a*, minute hand 17*b*, and second hand 17*c*) inside the exterior case 80 are visible through the cover glass plate 84.

The electronic apparatus 1*a* allows manual time correction through manual operation of a crown 86 and further allows switching between a normal time display mode and a time difference correction mode through manual operation of an operation button 87. The electronic apparatus 1*a* according to the present embodiment has a daily time correction function of automatically receiving GPS signals for time correction. Manual operation of the operation button 87 also allows forcible GPS signal reception.

Also in the present embodiment, an antenna 30 includes an arcuate first ribbon 31, a circuit substrate 26 (not shown in FIG. 16), and an arcuate second ribbon 35 (not shown in FIG. 16). The first ribbon 31 has an arcuate ribbon section 32, a linear power feeder 33, and a linear antenna electrode 34. Although not shown, the second ribbon 35 has an arcuate ribbon section 36 and a linear antenna electrode 37. The other configurations of the antenna 30 are the same as those in the first embodiment.

The first ribbon 31 and the second ribbon 35 in the present embodiment differ from those in the first embodiment in terms of the direction in which the ribbons extend from grounding points, and the ribbons extend in the counterclockwise direction in a plan view. Even when the first ribbon 31 and the second ribbon 35 extend in the counterclockwise direction, a decrease in the sensitivity due to parts around the ribbons in the case where the apparatus is worn around an arm can be avoided, as in the first embodiment.

As described above, the antenna 30 in the present disclosure is also applicable to a GPS watch having indication hands. Further, the direction in which the first ribbon 31 and the second ribbon 35 extend can be the counterclockwise direction.

The configurations in the second to fifth embodiments described above may be applied to a GPS watch having indication hands.

Variations

The present disclosure is not limited to the embodiments described above, and a variety of variations are conceivable, for example, as will be described below. Arbitrarily selected one or more of the aspects of the following variations can be combined with each other as appropriate.

Variation 1

Each of the above embodiments has been described with reference to the case where an arcuate ribbon is employed as each of the first ribbon 31 and the second ribbon 35. The present disclosure is, however, not limited to the case, and each of the first ribbon 31 and the second ribbon 35 may have a rectangular shape.

Figure 17:
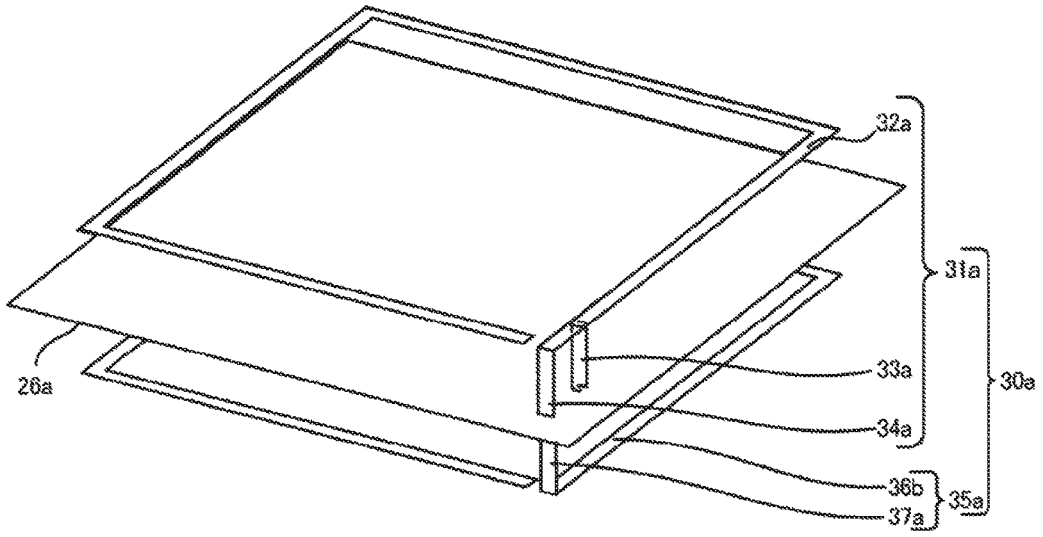
FIG. 17 is a diagrammatic view for describing the configuration of an antenna in a variation.

FIG. 17 is a diagrammatic view for describing the configuration of an antenna 30*a* in a case where ribbons each having a rectangular shape (square shape) are employed as the first ribbon 31*a* and the second ribbon 35*a*. In a case of a watch or any other electronic apparatus having a rectangular, tubular exterior case instead of a cylindrical exterior case in a plan view in the direction perpendicular to the display surface of the display section, each of a first ribbon 31*a* and a second ribbon 35*a* can also be formed in a rectangular shape in accordance with the shape of the exterior case.

The first ribbon 31*a* has a ribbon section 32*a*, and a rectangular antenna electrode 34*a* and power feeder 33*a* are connected to one end of the ribbon section 32*a*. Similarly, the second ribbon 35*a* has a ribbon section 36*b*, and a rectangular antenna electrode 37*a* is connected to one end of the ribbon section 36*b*. The second ribbon 35*a* is provided in a position where the first ribbon 31*a* and the second ribbon 35*a* are symmetric with respect to a circuit substrate 26*a*. The grounding points of the first ribbon 31*a* and the second ribbon 35*a* are set in electrically shared positions.

Each of the first ribbon 31*a* and the second ribbon 35*a* may be a rectangular ribbon as described above or an L-shaped ribbon.

When a bezel is used in the present variation, the bezel may also be formed in a rectangular frame shape. In either case, part of each of the ribbons may form a bent section.

Variation 2

Each of the above embodiments and variation has been described with reference to the case where the antenna according to the present disclosure receives a 1.5-GHz GPS electric wave, but the present disclosure is not limited to this configuration. The antenna according to the present disclosure is suitable for reception of electric waves having frequencies ranging, for example, from 100 MHz to 30 GHz.

To apply the present disclosure to an electronic apparatus having a wristwatch size, a GPS segment of 1.5 GHz and therearound or a wireless LAN segment of 2.4 GHz and therearound is most preferable. Further, to apply the present disclosure to an electronic apparatus having a mobile phone size, a segment of 700 MHz or 900 MHz, which is used for mobile phones, is most preferable.

Examples of a usable positioning satellite signal may include GLONASS (GLObal NAvigation Satellite System), GALILEO, BeiDou (BeiDou Navigation Satellite System), WAAS (Wide Area Augmentation System), and QZSS (Quasi Zenith Satellite System) as well as GPS.

Electric waves that comply with Bluetooth (registered trademark), Wi-Fi (registered trademark), and other standards may instead be received.

Variation 3

Each of the above embodiments and variations has been described with reference to the case where the equivalent electrical length of each of the first ribbon as the first radiation element and the second ribbon as the second radiation element is ¼ times the wavelength, but the present disclosure is not limited to this configuration. For example, the equivalent electrical length only needs to be an integer multiple of ¼ times the wavelength.

Variation 4

In the embodiments and the variations described above, a running watch and a GPS watch have been presented as examples of the electronic apparatus according to the present disclosure, but the present disclosure is not limited thereto. The present disclosure is applicable to a variety of electronic apparatus that receive an electric wave with an antenna and display information. For example, the present disclosure is also applicable to a wristwatch-type heart rate monitor, an earphone-type GPS apparatus, a smartphone and other electronic apparatus (electronic terminal), and a head mounted display and other wearable electronic apparatus.

What is claimed is:

1. An antenna comprising:

a first radiation element including a first linear element extending from an end of the first radiation element;

a ground plate having a grounding point to which the first linear element of the first radiation element is grounded; and a second radiation element including a second linear element extending from an end of the second radiation element, the second linear element grounded to the ground plate and in a position where the grounding point is electrically shared with the first radiation element, wherein the second radiation element is disposed along a direction of current produced by the first radiation element and flowing in the ground plate, and the first radiation element and the second radiation element overlap along a direction perpendicular to the planar surface of the ground plate, and wherein the first radiation element is arranged on a first surface of the ground plate, and the second radiation element is arranged on a second surface of the ground plate opposing the first surface.

2. The antenna according to claim 1, wherein the second radiation element is present in a position where the first radiation element and the second radiation element are symmetric with respect to the ground plate.

3. The antenna according to claim 1, wherein the second radiation element and the first radiation element are positioned along the same edge of the ground plate.

4. The antenna according to claim 1, wherein each of the first radiation element and the second radiation element has an arcuate shape in a plan view of the ground plate.

5. The antenna according to claim 1, wherein the second radiation element has a bent section.

6. The antenna according to claim 1, wherein each of the first radiation element and the second radiation element has an equivalent electrical length of ¼ times a wavelength.

7. An electronic apparatus comprising:

a first radiation element including a first linear element extending from an end of the first radiation element;

a ground plate having a grounding point to which the first linear element of the first radiation element is grounded; and a second radiation element including a second linear element extending from an end of the second radiation element, the second linear element grounded to the ground plate and in a position where the grounding point is electrically shared with the first radiation element, wherein the second radiation element is disposed along a direction of current produced by the first radiation element and flowing in the ground plate, and the first radiation element and the second radiation element overlap along a direction perpendicular to the planar surface of the ground plate, and wherein the first radiation element is arranged on a first surface of the ground plate, and the second radiation element is arranged on a second surface of the ground plate opposing the first surface.

8. The electronic apparatus according to claim 7, further comprising:

a display section;

a case that accommodates the display section and the antenna and includes a case back; and a passive element containing a metal, wherein the passive element is positioned on an opposite side of the display section with respect to the case back, and the first radiation element is positioned between the passive element and the case back.

9. The electronic apparatus according to claim 7, wherein the ground plate is a circuit substrate of the electronic apparatus.

* * * * *